US005946013A

United States Patent [19]

Kurihara et al.

[11] Patent Number: 5,946,013

[45] Date of Patent: Aug. 31, 1999

[54] INK JET HEAD HAVING A PROTECTIVE LAYER WITH A CONTROLLED ARGON CONTENT

[75] Inventors: Suomi Kurihara; Yasumasa Yokoyama, both of Yokohama; Hiroto Matsuda, Ebina; Hirokazu Komuro, Yokohama; Isao Kimura, Kawasaki, all of Japan

[73] Assignee: Canon Kabushiki Kaisha, Tokyo, Japan

[21] Appl. No.: 08/646,552

[22] Filed: May 8, 1996

Related U.S. Application Data

[63] Continuation of application No. 08/171,168, Dec. 22, 1993, abandoned.

[30] Foreign Application Priority Data

Dec. 22, 1992 [JP] Japan ..... 4-342161

[51] Int. Cl.[6] ..... B41J 2/05

[52] U.S. Cl. ..... 347/64; 204/192.23; 347/203

[58] Field of Search ..... 347/64, 203; 204/192.23, 204/192.22, 192.13

[56] References Cited

U.S. PATENT DOCUMENTS

| | | | |
|---|---|---|---|
| 3,617,459 | 11/1971 | Logan | 204/192.23 |
| 3,658,678 | 4/1972 | Gregor | 204/192.23 |
| 4,313,124 | 1/1982 | Hara . | |
| 4,336,548 | 6/1982 | Matsumoto | 347/64 |
| 4,345,262 | 8/1982 | Shirato et al. . | |
| 4,459,600 | 7/1984 | Sato et al. . | |
| 4,463,359 | 7/1984 | Ayata et al. . | |
| 4,536,250 | 8/1985 | Ikeda et al. . | |
| 4,558,333 | 12/1985 | Sugitani et al. . | |
| 4,567,493 | 1/1986 | Ikeda et al. . | |
| 4,596,994 | 6/1986 | Matsuda et al. . | |
| 4,602,261 | 7/1986 | Matsuda et al. . | |
| 4,631,555 | 12/1986 | Ikeda et al. . | |
| 4,694,306 | 9/1987 | Ikeda et al. . | |
| 4,720,716 | 1/1988 | Ikeda et al. . | |
| 4,723,129 | 2/1988 | Endo et al. . | |
| 4,725,859 | 2/1988 | Shibata et al. . | |
| 4,740,796 | 4/1988 | Endo et al. . | |
| 4,889,587 | 12/1989 | Komuro . | |
| 4,936,952 | 6/1990 | Komuro . | |
| 4,965,594 | 10/1990 | Komuro . | |
| 4,968,992 | 11/1990 | Komuro | 347/64 |
| 5,047,131 | 9/1991 | Wolfe | 204/192.23 |
| 5,062,937 | 11/1991 | Komuro | 347/64 X |
| 5,066,963 | 11/1991 | Kimura et al. | 346/140 R |
| 5,140,345 | 8/1992 | Komuro | 346/140 R |
| 5,211,754 | 5/1993 | Komuro | 118/300 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Joseph Hartary
*Attorney, Agent, or Firm*—Fitzpatrick, Cella, Harper & Scinto

[57] ABSTRACT

Disclosed is a thin-film resistor element for an ink jet head. In the thin-film resister element, a protective film is used having a multi-layered structure, the proportion of Ar atoms contained in a lower area of the protective film located in contact with the heating resistor is set between 0.2 wt % and 6.0 wt %, and that in an upper area of the protective film is set between 1.0 wt % and 9.0 wt %.

11 Claims, 13 Drawing Sheets

FIG. 11

| | CONSTRUCTION OF PROTECTIVE FILM | Ar CONTENT IN PROTECTIVE FILM (wt%) | $5 \times 10^7$ (FILM SWELL (%)) | $1 \times 10^8$ (FILM SWELL (%)) | PEEL TEST | EVALUATION |
|---|---|---|---|---|---|---|
| EXAMPLE 1 | SINGLE LAYER | 6.0 | 0 | 0 | NO PEEL | ○ |
| EXAMPLE 2 | SINGLE LAYER | 3.0 | 0 | 0 | NO PEEL | ○ |
| EXAMPLE 3 | SINGLE LAYER | 1.0 | 0 | 0 | NO PEEL | ○ |
| EXAMPLE 4 | SINGLE LAYER | 0.2 | 0 | 0 | NO PEEL | ○ |
| EXAMPLE 5 | SINGLE LAYER | 1.0 | 0 | 0 | NO PEEL | ○ |
| EXAMPLE 6 | SINGLE LAYER | 5.0 | 0 | 0 | NO PEEL | ○ |
| EXAMPLE 7 | SINGLE LAYER | 4.0 | 0 | 0 | NO PEEL | ○ |
| EXAMPLE 8 | SINGLE LAYER | 2.0 | 0 | 0 | NO PEEL | ○ |
| EXAMPLE 9 | SINGLE LAYER | 6.0 | 0 | 0 | NO PEEL | ○ |
| EXAMPLE 10 | SINGLE LAYER | 1.0 | 0 | 0 | NO PEEL | ○ |
| COMPARATIVE EXAMPLE 1 | SINGLE LAYER | 7.0 | 45 | 80 | NO PEEL | × |
| COMPARATIVE EXAMPLE 2 | SINGLE LAYER | 0.1 | 0 | 0 | PEELED | × |
| COMPARATIVE EXAMPLE 3 | SINGLE LAYER | 0.0 | 0 | 0 | PEELED | × |
| COMPARATIVE EXAMPLE 4 | SINGLE LAYER | 7.0 | 55 | 85 | NO PEEL | × |

FIG. 12

| | CONSTRUCTION OF PROTECTIVE FILM | Ar CONTENT IN PROTECTIVE FILM (wt%) | NUMBER OF PULSES SUSTAINED BEFORE CUTTING (RELATIVE VALUE) |
|---|---|---|---|
| EXAMPLE 1 | SINGLE LAYER | 6.0 | 680 |
| EXAMPLE 2 | SINGLE LAYER | 3.0 | 1500 |
| EXAMPLE 3 | SINGLE LAYER | 1.0 | 5800 |
| EXAMPLE 4 | SINGLE LAYER | 0.2 | 6500 |
| EXAMPLE 5 | SINGLE LAYER | 1.0 | 6700 |
| EXAMPLE 6 | SINGLE LAYER | 5.0 | 650 |
| EXAMPLE 7 | SINGLE LAYER | 4.0 | 480 |
| EXAMPLE 8 | SINGLE LAYER | 2.0 | 1500 |
| EXAMPLE 9 | SINGLE LAYER | 6.0 | 550 |
| EXAMPLE 10 | SINGLE LAYER | 1.0 | 4800 |
| COMPARATIVE EXAMPLE 1 | SINGLE LAYER | 7.0 | 1 |
| COMPARATIVE EXAMPLE 4 | SINGLE LAYER | 7.0 | 2 |

FIG. 13

| | CONSTRUCTION OF PROTECTIVE FILM | Ar CONTENT IN PROTECTIVE FILM (wt%) | | $5\times10^7$ PULSES APPLIED | | $1\times10^8$ PULSES APPLIED | |
|---|---|---|---|---|---|---|---|
| | | LOWER PART | UPPER PART | SWELL (%) | PEEL (%) | SWELL (%) | PEEL (%) |
| EXAMPLE 11 | MULTI-LAYERED | 6.0 | 9.0 | 0 | 0 | 0 | 0 |
| EXAMPLE 12 | MULTI-LAYERED | 6.0 | 1.0 | 0 | 0 | 0 | 0 |
| EXAMPLE 13 | MULTI-LAYERED | 0.2 | 9.0 | 0 | 0 | 0 | 0 |
| EXAMPLE 14 | MULTI-LAYERED | 0.2 | 1.0 | 0 | 0 | 0 | 0 |
| EXAMPLE 15 | MULTI-LAYERED | 6.0 | 9.0 | 0 | 0 | 0 | 0 |
| EXAMPLE 16 | MULTI-LAYERED | 6.0 | 1.0 | 0 | 0 | 0 | 0 |
| EXAMPLE 17 | MULTI-LAYERED | 0.2 | 9.0 | 0 | 0 | 0 | 0 |
| EXAMPLE 18 | MULTI-LAYERED | 0.2 | 1.0 | 0 | 0 | 0 | 0 |
| COMPARATIVE EXAMPLE 5 | MULTI-LAYERED | 7.0 | 7.0 | 20 | 0 | 60 | 0 |
| COMPARATIVE EXAMPLE 6 | MULTI-LAYERED | 0.2 | 0.2 | 0 | 0 | 0 | 50 |
| COMPARATIVE EXAMPLE 7 | MULTI-LAYERED | 0.9 | 0.9 | 0 | 0 | 0 | 20 |
| COMPARATIVE EXAMPLE 8 | MULTI-LAYERED | 7.0 | 10.0 | 40 | 5 | 70 | 10 |
| COMPARATIVE EXAMPLE 9 | MULTI-LAYERED | 7.0 | 7.0 | 30 | 0 | 70 | 0 |
| COMPARATIVE EXAMPLE 10 | MULTI-LAYERED | 0.2 | 0.2 | 0 | 0 | 0 | 50 |
| COMPARATIVE EXAMPLE 11 | MULTI-LAYERED | 7.0 | 10.0 | 60 | 5 | 90 | 20 |

FIG. 14

| | | Ar CONTENT IN PROTECTIVE FILM (wt%) | | PROTECTIVE FILM THICKNESS (%) | | $5\times10^7$ PULSES APPLIED | | $1\times10^8$ PULSES APPLIED | |
|---|---|---|---|---|---|---|---|---|---|
| | | LOWER PART | UPPER PART | LOWER PART | UPPER PART | SWELL OF PROTECTIVE FILM (%) | PEEL OF PROTECTIVE FILM (%) | SWELL OF PROTECTIVE FILM (%) | PEEL OF PROTECTIVE FILM (%) |
| EXAMPLE 11-1 | LAMINATE | 6.0 | 9.0 | 50 | 50 | 0 | 0 | 0 | 0 |
| EXAMPLE 11-2 | LAMINATE | 6.0 | 9.0 | 90 | 10 | 0 | 0 | 0 | 0 |
| EXAMPLE 11-3 | LAMINATE | 6.0 | 9.0 | 70 | 30 | 0 | 0 | 0 | 0 |
| EXAMPLE 11-4 | LAMINATE | 6.0 | 9.0 | 40 | 60 | 10 | 0 | 50 | 0 |
| EXAMPLE 11-5 | LAMINATE | 6.0 | 9.0 | 10 | 90 | 20 | 0 | 80 | 0 |
| EXAMPLE 13-1 | LAMINATE | 0.2 | 9.0 | 50 | 50 | 0 | 0 | 0 | 0 |
| EXAMPLE 13-2 | LAMINATE | 0.2 | 9.0 | 90 | 10 | 0 | 0 | 0 | 0 |
| EXAMPLE 13-3 | LAMINATE | 0.2 | 9.0 | 70 | 30 | 0 | 0 | 0 | 0 |
| EXAMPLE 13-4 | LAMINATE | 0.2 | 9.0 | 40 | 60 | 0 | 0 | 30 | 0 |
| EXAMPLE 13-5 | LAMINATE | 0.2 | 9.0 | 10 | 90 | 10 | 0 | 50 | 0 |

INK JET HEAD HAVING A PROTECTIVE LAYER WITH A CONTROLLED ARGON CONTENT

This application is a continuation of application Ser. No. 08/171,168, filed Dec. 22, 1993, now abandoned.

BACKGROUND OF THE INVENTION

Field of the Invention and Related Art

The present invention relates to a thin-film resistor element in which a protective film (layer) made of an electrical insulator is disposed on a heating resistor, an ink jet head employing such a thin-film resistor element, and an ink jet recording apparatus in which such an ink jet head is mounted.

Thin-film resistor elements are used in, for example, a thermal head used for thermal printing on sheets of heat sensitive paper and an ink jet recording head used in the ink jet recording process in which ink is heated and discharged in bubbles.

The above-described thin-film resistor element always has a heating resistor for generating heat. In addition to the heating resistor, most thin-film resistor elements have a protective film on the heating resistor for various reasons, such as to prevent oxidation of the heating resistor or improve the wear resistance of the heating resistor.

The ink jet recording process assures high-speed, high-density and high-definition recording exhibiting a high image quality and is suited for color and compact recording. Thus, the ink jet recording process has been drawing attention in recent years. The thin-film resistor element for an ink jet recording head, however, requires a protective film which performs better than that for a thermal head, because the heat acting portion of the ink jet recording head makes direct contact with the ink, because the heat acting portion is subjected to a large mechanical shock due to cavitation which occurs when ink bubbling and bursting is repeated, and because changes in temperature of several hundred degrees occur in the heat acting portion in an extremely short period of time, e.g., in the order of $10^{-1}$ to 10 microseconds. Generally, recent technologies allow the formation of an electrical insulating layer made of, for example, $SiO_2$, SiC or $Si_3N_4$, on the heating resistor as the protective film for the ink jet head, or the formation of both such an electrical insulating layer on the heating resistor and a cavitation resistant layer made of, for example, Ta on the electrical insulating layer, as the protective film.

In a thin-film resistor element with any of the above-described protective films provided therein, the protection capability and stability of the protective film dominate the durability of the element. Thus, the formation of a protective film exhibiting the highest possible reliability has been of a great technical interest.

However, the above-described thin-film resistor element has a problem in that a particular film forming process used to form a protective film on the heating resistor in the manufacture of the thin-film resistor elements produces many defective thin-film resistor elements by which the protective film readily swells or peels off when the heating resistor is energized, particularly when the heating resistor is repetitively energized, even if the same material or the same structure is employed to form the protective film. In such a thin-film resistor element in which the above-described defect has occurred, the resistor may break because it is no longer in thermal contact with the protective film. In the ink jet head, the generation of the defect reduces thermal conductivity of the ink and the ink may not be discharged.

SUMMARY OF THE INVENTION

In view of the aforementioned problems of the prior art, an object of the present invention is to provide a highly reliable thin-film resistor element, an ink jet head employing such a thin-film resistor element, and an ink jet recording apparatus in which such an ink jet head is mounted.

To achieve the aforementioned objects, the present invention provides a thin-film resistor element in which a protective layer (film) made of an electrical insulator is provided in contact with the heating resistor. The proportion of argon (Ar) atoms contained in the protective layer ranges between 0.2 wt % and 6.0 wt %.

In the thin-film resistor element, the protective layer may have a multi-layered structure. In that case, the proportion of argon (Ar) atoms in the lower region of the protective layer in contact with the heating resistor, is between 0.2 wt % and 6.0 wt %, and that of argon in the upper region is between 1.0 wt % and 6.0 wt %.

The present invention further provides an ink jet head employing any of the above thin-film resistor elements, an ink jet recording apparatus in which such an ink jet head is mounted, and a method of manufacturing a thin-film resistor element.

BRIEF DESCRIPTION OF THE DRAWINGS

FIG. 3 (*b*) is a schematic cross-sectional view of the thin-film resistor element employed in the ink jet head of FIG. 3 (*a*);

FIG. 11 shows the results of Examples 1 through 10 and Comparative Examples 1 through 4;

FIG. 12 illustrates the relation between the amount of Ar and the number of pulses sustained before cutting in Examples 1 through 10 and Comparative Examples 1 and 4;

FIG. 13 shows the results of Examples 11 through 18 and Comparative Examples 5 through 11; and FIG. 14 is a list showing the values for defining the thickness of an upper region and that of a lower region in a first protective film.

DETAILED DESCRIPTION OF THE PREFERRED EMBODIMENTS

Before giving a detailed description of the present invention, the knowledge gained from the experiments by the present inventors will be described.

Figure 10:
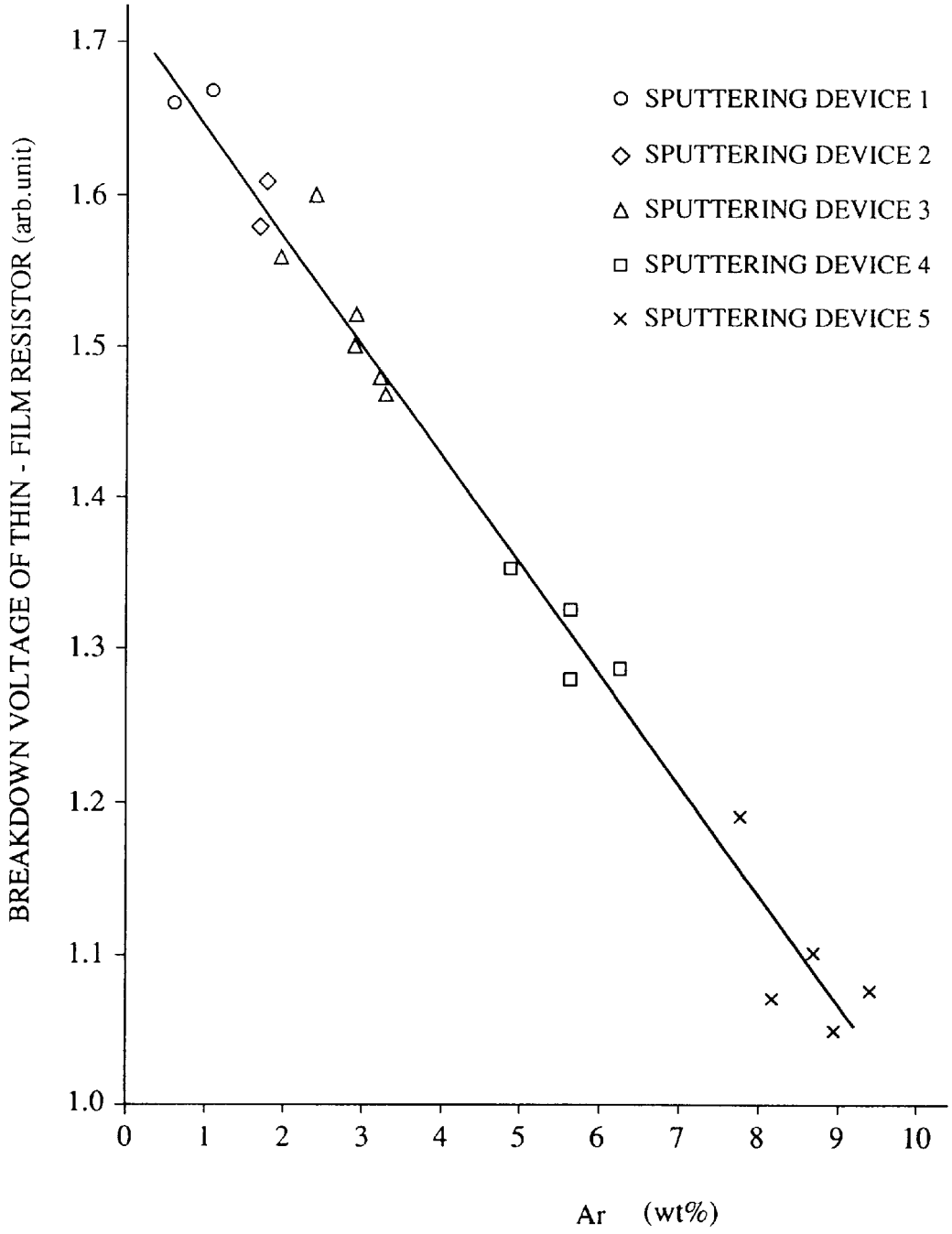
FIG. 10 is a graph showing the relationship between the amount of Ar in a protective film of the thin-film resistor element and the withstand voltage.

In order to achieve the above-described object, the present inventors compared defective thin-film resistor elements and nondefective thin-film resistor elements to study the causes of generation of defectives. Consequently, the present inventors found that the amount of Ar atoms in the region of the protective layer (film) in contact with the heating resistor in defective thin-film resistor elements is larger than that of Ar atoms in the protective film provided in nondefective thin-film resistor elements. FIG. 10 is a graph showing the relationship between the amount (wt %) of Ar in the protective film and the applied voltage when an abnormality has occurred in the thin-film resistor element. The abscissa axis denotes the amount of Ar in the protective film obtained by measuring the X-ray intensity ratio of the types of atoms in the protective film by an electron beam micro analyzer (EPMA) and then by correcting differences in the types of atoms of the measured X-ray intensity ratio. The ordinate axis denotes the applied voltage. The units of applied voltage are arbitrary ones in which a difference in the resistance of the elements has been corrected.

It can be seen from the graph of FIG. 10 that the greater the amount of Ar atoms contained in the region of the protective film in contact with the heating resistor, the lower the applied voltage at which the defect has occurred. Thus, the thin-film resistor element manufactured by a sputter apparatus No. 5 is not practical because the protective film thereof contains a large amount of Ar atoms.

In a thin-film resistor element whose protective film contains less than 0.2 wt % of Ar atoms, the protective film and the heating resistor are readily separated from each other at an interface therebetween because both the physical distortion contributing to the adhesion of the interface therebetween and dangling bonds for coupling the protective film to the resistor heater are generally reduced. Thus, the desired proportion of Ar atoms is 0.2 wt % or above, and hence the protective film forming method which does not utilize Ar, such as evaporation due to resistor heating, is not desirable because the formed protective film does not contain Ar at all. Any other protective film forming method can be used if that method assures adhesion between the protective film and the heating resistor.

In the present invention, if the amount of Ar is 0.2 wt % or above, the smaller the amount of Ar, the better the production of nondefective thin-film resistor elements. The present inventors found that the necessary reliability of the products is obtained when the proportion of Ar atoms contained in the protective film is between 0.2 wt % and 6.0 wt %, preferably between 0.2 wt % and 3.0 wt %, and more preferably between 0.2 wt % and 1.0 wt %.

The above-described conditions regarding the amount of Ar are satisfied by any of the following means.

1. Heating of the protective film using a heater or an infrared lamp during or after the formation thereof.
2. Illumination of ionizing radiation on the protective film during or after the formation thereof.
3. Alteration of the protective film forming conditions.

When the means 1 is employed during formation of the protective film, the Ar atoms remaining in the protective film become scarce. When the means 1 is used after the protective film has been formed, the Ar atoms are subjected to heat energy and escape from the protective film. Consequently, the amount of Ar atoms in the protective film can be reduced. The above-described effect generally appears when the temperature is 400° C. or above, and the higher the temperature, the more effective removal can be achieved. Thus, an increase in the temperature of the heating resistor to the highest possible value is desirable in order to reduce the amount of Ar atoms in the protective film. However, excessively high temperature may deform the thin film due to aggregation thereof. Particularly, Al, which is extensively used as the interconnection material, has a relatively low melting point of 660° C. Thus, a desirable temperature of the heating resistor during or after formation of the protective film is between 400° C. and 600° C. This, however, does not apply to thin-film resistor elements which employ a material resistant to high temperatures.

The illumination of ionizing radiation to the protective film, itemized as means 2, imparts excitation energy to the Ar atoms in the protective film, accelerating escape thereof from the protective film.

Regarding the means 3, when the protective film is formed by, for example, sputtering, the amount of Ar in the protective film is reduced, for example, by changing the film formation conditions or apparatus.

The amount of Ar that the present inventors have found necessary in the protective film formed in contact with the heating resistor has been described above.

They also discovered that, when the protective film provided in contact with the heating resistor has a multi-layered structure consisting of a first protective layer in contact with the heating resistor and a second protective layer formed on the first protective film, excessive reduction in the amount of Ar in the vicinity of the joining surfaces between the first and second protective layers (hereinafter referred to as an upper portion) reduces the physical deformation of and dangling bonds in the surface of the first protective film, thus reducing adhesion therebetween.

Accordingly, in the case of a protective layer having a multi-layered structure, the present inventors came to the conclusion that the amount of Ar should be determined taking into consideration the adhesion between the protective layers.

In the present invention, when the protective film has a multi-layered structure, the amount of Ar in the lower portion of the first protective film (located close to the heating resistor) is between 0.2 wt % and 6.0 wt %, and the amount of Ar in the upper portion thereof is between 1.0 wt % and 9.0 wt %.

If the amount of Ar is distributed in the protective film, as in the aforementioned case, the formation of the protective film becomes easier by changing the amount of Ar non-continuously or the strength of the protective film is increased by changing the amount of Ar continuously.

Examples of the present invention will now be described in detail.

First, examples of the thin-film resistor element having a single layered protective film will be described.

EXAMPLE 1

Figure 1:
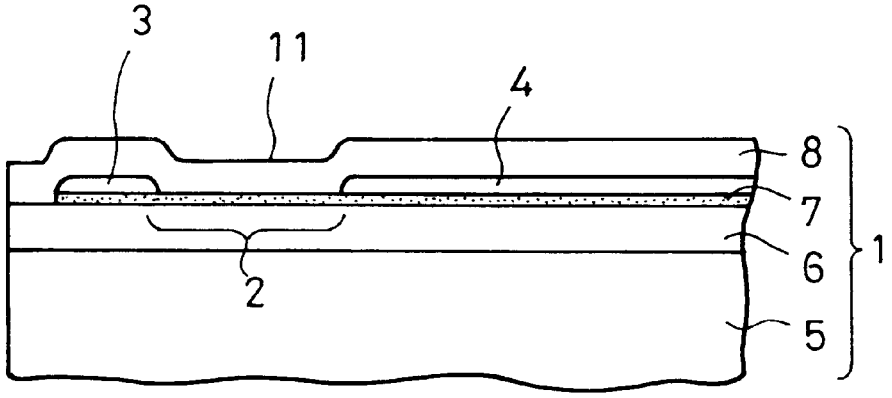
FIG. 1 is a schematic cross-sectional view illustrating the structure of a thin-film resistor element of the present invention and Comparative Examples.
Figure 2:
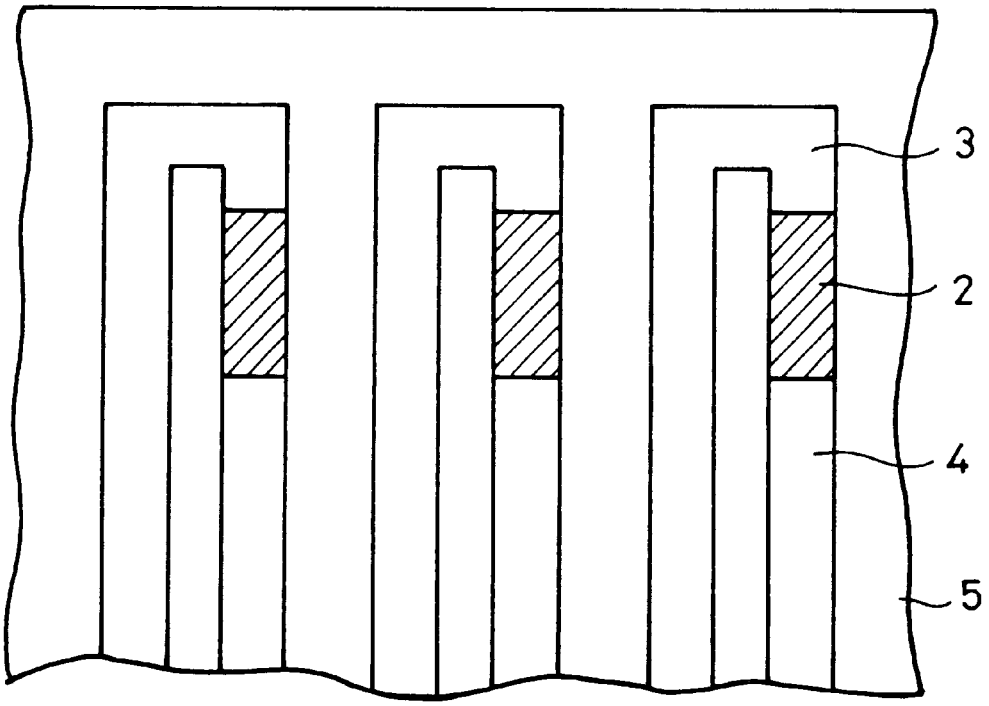
FIG. 2 is a schematic plan view illustrating the structure of a thin-film resistor element of the present invention and Comparative Examples.

FIGS. 1 and 2 are respectively cross-sectional and plan views of Example 1 of the thin-film resistor element according to the present invention. In the figures, reference numeral 1 denotes a thin-film resistor element (the entirety); reference numeral 2 denotes a heating portion; and reference numerals 3 and 4 denote electrodes.

The manufacturing process of the thin-film resistor element of this example will be described.

First, a 5 $\mu$m-thick $SiO_2$ film was formed on the surface of a Si wafer which was an element supporting member 5 by thermal oxidation to form a lower layer 6 of an element 1. Next, a heating resistor layer 7 of $HfB_2$ was formed to a thickness of 1300 Å on the lower layer 6 by sputtering.

Subsequently, a Ti layer and an Al layer were sequentially deposited with 50 Å and 5000 Å thickness, respectively, by electron beam deposition to form both the common interconnect electrode 3 and the selective interconnect electrode 4. At that time, a circuit pattern shown in FIG. 2 was formed by the photolithographic process. The heat acting surface of the heating portion 2 which formed a heat generating portion 11 for generating heat when a voltage was applied to the interconnect electrodes 3 and 4 had a width of 30 $\mu$m and a length of 150 $\mu$m. The resistance of the heating portion including that of the Al interconnect electrodes 3 and 4 was 100 Ω.

Finally, the element supporting member 5 was set in an Ar sputtering apparatus (apparatus No. 5 marked by X in FIG. 10) in contact with a heater heated to 400° C., and a 1.9 $\mu$m-thick protective film 8 made of $SiO_2$ was deposited on the entire surface of the element 1 in the manner shown in FIG. 1 by the magnetron type high-rate sputtering process. At that time, the Ar gas pressure was 4 mTorr, and the Rf power supplied was 4.0 kW.

In addition to Si, an insulator, such as glass or a ceramic, may also be used as the material of the element supporting member 5. Any other material than $HfB_2$ can be used as the material of the heating resistor layer 7 which is heated to a very high temperature when the element is energized, if that material is stable at high temperatures and exhibits excellent oxidation resistance. Examples of such materials include a nitride, a carbide, a silicide and a fluoride of a high melting point or transition metal. Among such materials, tantalum nitride is desirable. A good conductor, such as Au or Cu, can also be used as the material of the interconnect electrodes 3 and 4. The thickness of the protective film 8 and the width and length of the heating portion 2 are set to adequate values which assure the necessary characteristics of the heat generating portion 11 according to the design of the thin-film resistor element. In addition to $SiO_2$, SiC or SiN can also be used to form the protective film 8.

Regarding the thin-film resistor elements manufactured in the manner described above, the present inventors measured the amount of Ar in the protective film using EPMA. The average amount of Ar in the protective film was 6.0 wt %.

The rate at which an abnormality, such as swelling of the protective film, appeared in the similarly manufactured thin-film resistor elements when a pulse voltage of 26 volts was applied thereto at 3 kHz for 10 $\mu$sec $5\times10^7$ times (hereinafter referred to as a first condition) or $1\times10^8$ times (hereinafter referred to as a second condition) was 0% in both cases. In Comparative Example 1 which will be described later, the rate at which an abnormality appeared when a driving signal was applied under the same conditions $5\times10^7$ times was about 45%, and the rate at which an abnormality appeared when a driving signal was applied $1\times10^8$ times was about 80%. Thus, in Example 1, since the protective film was formed such that it contained a lesser amount of Ar, there was no thin-film resistor element in which an abnormality, such as swelling of the protective film, occurred.

EXAMPLE 2

In Example 2, the same thin-film resistor elements as those of Example 1 were manufactured in the same manner as that of Example 1 except that the temperature of the heater which was in contact with the element supporting member 5 during formation of the protective film 8 was 600° C.

The measurements of the amount of Ar in the protective film of each of the thin-film resistor elements manufactured in the manner described above using EPMA indicated that the average amount thereof was 3.0 wt %.

The rate at which an abnormality, such as swelling of the protective film, appeared in the similarly manufactured thin-film resistor elements when a pulse voltage of 26 volts was applied thereto at 3 kHz for 10 $\mu$sec under the first and second conditions was 0% in both cases. In Example 2, since the protective film was formed such that it contained less amount of Ar, the number of thin-film resisto elements in which an abnormality, such as swelling of the protective film, occurred was reduced.

EXAMPLE 3

In Example 3, the same thin-film resistor elements as those of Example 1 were manufactured in the same manner as that of Examples 1 and 2. However, unlike the cases of Examples 1 and 2, an Ar sputtering apparatus No. 1 indicated by o in FIG. 10 was used to form the protective film. At that time, the heater was not heated. The Ar gas pressure was 3 mTorr. The Rf power applied was 8.0 kW.

The measurements of the amount of Ar in the protective film of each of the thin-film resistor elements manufactured in the manner described above using EPMA indicated that the average amount thereof was 1.0 wt %.

The rate at which an abnormality, such as swelling of the protective film, appeared in the similarly manufactured thin-film resistor elements when a pulse voltage of 26 volts was applied thereto at 3 kHz for 10 $\mu$sec under the first and second conditions was 0% in both cases. Thus, in Example 3, since the protective film was formed such that it contained a lesser amount of Ar, the number of thin-film resistor elements in which an abnormality, such as swelling of the protective film, occurred was reduced.

EXAMPLE 4

In Example 4, the same thin-film resistor elements as those of Example 1 were manufactured in the same manner as that of Example 3 except for the conditions under which the protective film was formed. That is, the heater was heated to 600° C. in Example 4.

The measurements of the amount of Ar in the protective film of each of the thin-film resistor elements manufactured in the manner described above using EPMA indicated that the average amount thereof was 0.2 wt %.

The rate at which an abnormality, such as swelling of the protective film, appeared in the similarly manufactured thin-film resistor elements when a pulse voltage of 26 volts was applied thereto at 3 kHz for 10 $\mu$sec under the first and second conditions was 0% in both cases. Thus, in Example 4, since the protective film was formed such that it contained a lesser amount of Ar, the number of thin-film resistor elements in which an abnormality, such as swelling of the protective film, occurred was reduced.

EXAMPLE 5

In Example 5, the same thin-film resistor elements as those of Example 1 were manufactured in the same manner as that of Example 1 except for the conditions under which the protective film 8 was formed. That is, in Example 5, the heater was not heated, and the element was baked for 1 hour at 600° C. in $N_2$ after the formation of the protective film, unlike the case of Example 1.

The measurements of the amount of Ar in the protective film of each of the thin-film resistor elements manufactured in the manner described above using EPMA indicated that the average amount thereof was 1.0 wt %.

The rate at which an abnormality, such as swelling of the protective film, appeared in the similarly manufactured thin-film resistor elements when a pulse voltage of 26 volts was applied thereto at 3 kHz for 10 μsec under the first and second conditions was 0% in both cases. Thus, in Example 5, since the protective film was formed such that it contained lesser amount of Ar, the number of thin-film resistor elements in which an abnormality, such as swelling of the protective film, occurred was reduced.

EXAMPLE 6

In Example 6, the same thin-film resistor elements as those of Example 1 were manufactured in the same manner as that of Example 1 except for the conditions under which the protective film 8 was formed. That is, in Example 6, the heater was heated to a temperature slightly higher than the temperature of Example 1.

The measurements of the amount of Ar in the protective film of each of the thin-film resistor elements manufactured in the manner described above using EPMA indicated that the average amount thereof was 5.0 wt %.

The rate at which an abnormality, such as swelling of the protective film, appeared in the similarly manufactured thin-film resistor elements when a pulse voltage of 26 volts was applied thereto at 3 kHz for 10 μsec under the first and second conditions was 0% in both cases. Thus, in Example 6, since the protective film was formed such that it contained a lesser amount of Ar, the number of thin-film resistor elements in which an abnormality, such as swelling of the protective film, occurred was reduced.

EXAMPLE 7

In Example 7, the same thin-film resistor elements as those of Example 1 were manufactured in the same manner as that of Example 1 except for the conditions under which the protective film 8 was formed. That is, in Example 7, the heater was heated to a temperature slightly higher than the temperature of Example 6.

The measurements of the amount of Ar in the protective film of each of the thin-film resistor elements manufactured in the manner described above using EPMA indicated that the average amount thereof was 4.0 wt %.

The rate at which an abnormality, such as swelling of the protective film, appeared in the similarly manufactured thin-film resistor elements when a pulse voltage of 26 volts was applied thereto at 3 kHz for 10 μsec under the first and second conditions was 0% in both cases. Thus, in Example 7, since the protective film was formed such hat it contained a lesser amount of Ar, the number of thin-film resistor elements in which an abnormality, such as swelling of the protective film, occurred was reduced.

EXAMPLE 8

In Example 8, the same thin-film resistor elements as those of Example 1 were manufactured in the same manner as that of Example 2 except for the conditions under which the protective film 8 was formed. That is, in Example 8 the heater was heated to a temperature slightly higher than the temperature of Example 2.

The measurements of the amount of Ar in the protective film of each of the thin-film resistor elements manufactured in the manner described above using EPMA indicated that the average amount thereof was 2.0 wt %.

The rate at which an abnormality, such as swelling of the protective film, appeared in the similarly manufactured thin-film resistor elements when a pulse voltage of 26 volts was applied thereto at 3 kHz for 10 μsec under the first and second conditions was 0% in both cases. Thus, in Example 8, since the protective film was formed such that it contained a lesser amount of Ar, the number of thin-film resistor elements in which an abnormality, such as swelling of the protective film, occurred was reduced.

Comparative Example 1

In Comparative Example 1, the same thin-film resistor elements as those of Example 1 were manufactured in the same manner as that of Example 2 except for the conditions under which the protective film 8 was formed. That is, in Comparative Example 1, the heater to which the element supporting member 5 was brought into contact was not heated, unlike the case of Example 1.

The measurements of the amount of Ar in the protective film of each of the thin-film resistor elements manufactured in the manner described above using EPMA indicated that the average amount thereof was 7.0 wt %.

When a pulse voltage of 26 volts was applied to the similarly manufactured thin-film resistor elements at 3 kHz for 10 μsec under the first and second conditions, the rate at which an abnormality, such as swelling of the protective film, appeared in the elements under the first condition was 45% while the rate obtained under the second condition was 80%.

Comparative Example 2

In Comparative Example 2, the same thin-film resistor elements as those of Example 1 were manufactured in the same manner as that of Example 4 except for the conditions under which the protective film 8 was formed. That is, in Comparative Example 2, the heater was heated to a temperature slightly higher than that of Example 4.

The measurements of the amount of Ar in the protective film of each of the thin-film resistor elements manufactured in the manner described above using EPMA indicated that the average amount thereof was 0.1 wt %.

When a pulse voltage of 26 volts was applied to the similarly manufactured thin-film resistor elements in the aforementioned manner under the first and second conditions, no abnormality of the protective film, such as swelling thereof occurred.

However, in the peeling test conducted by pasting an adhesive tape to the protective film, the film readily peeled off.

Comparative Example 3

In Comparative Example 3, the same thin-film resistor elements as those of Example 1 were manufactured in the same manner as that of Example 1 except for the conditions under which the protective film 8 was formed. That is, in Comparative Example 3, the protective film 8 was formed in such a manner that no Ar gas entered the film forming chamber, and was heated by the heater.

The measurements of the amount of Ar in the protective film of each of the thin-film resistor elements manufactured in the manner described above using EPMA indicated that essentially no Ar was present in the protective film.

The peeling test conducted in the same manner as that of Comparative Example 2 indicated that the film readily peeled off.

The present inventors consider that in Comparative Examples 2 and 3, adhesion of the protective film to the heating resistor layer deteriorated because the amount of Ar contained was too small.

Examples of the thin-film resistor element having a single layered protective film according to the present invention have been described above.

Now, examples of the liquid jet head employing the thin-film resistor element according to the present invention will be described.

EXAMPLE 9

Figure 3A:
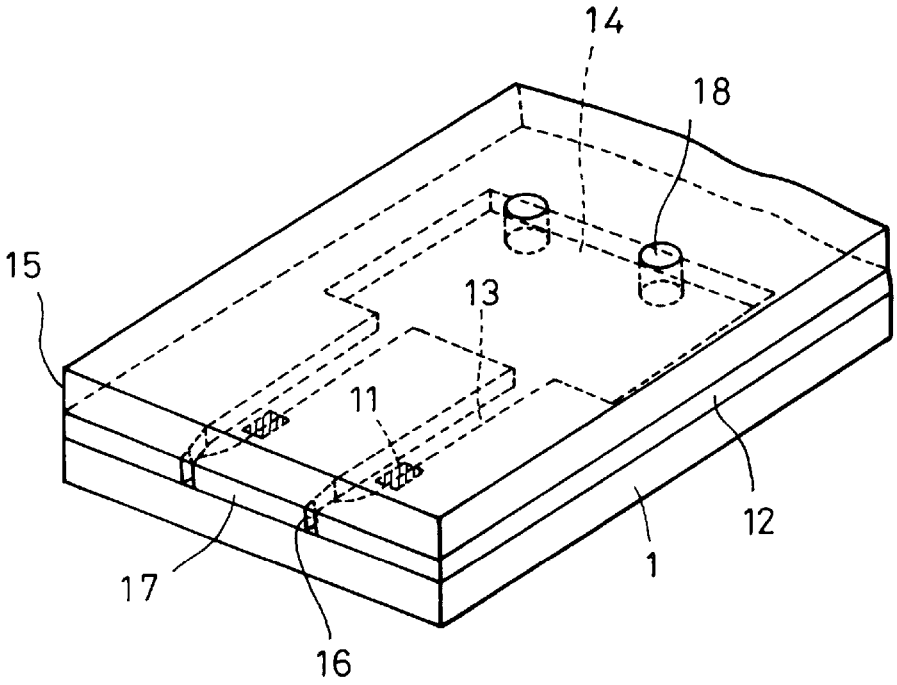
FIG. 3 (*a*) is a perspective view of part of an ink jet head employing the thin-film resistor element according to the present invention.
Figure 3B:
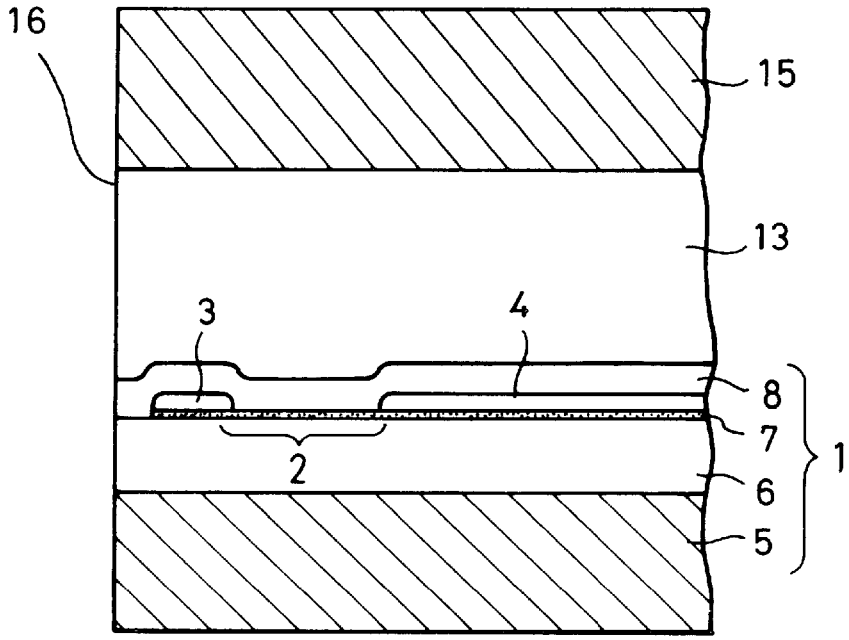
Figure 7:
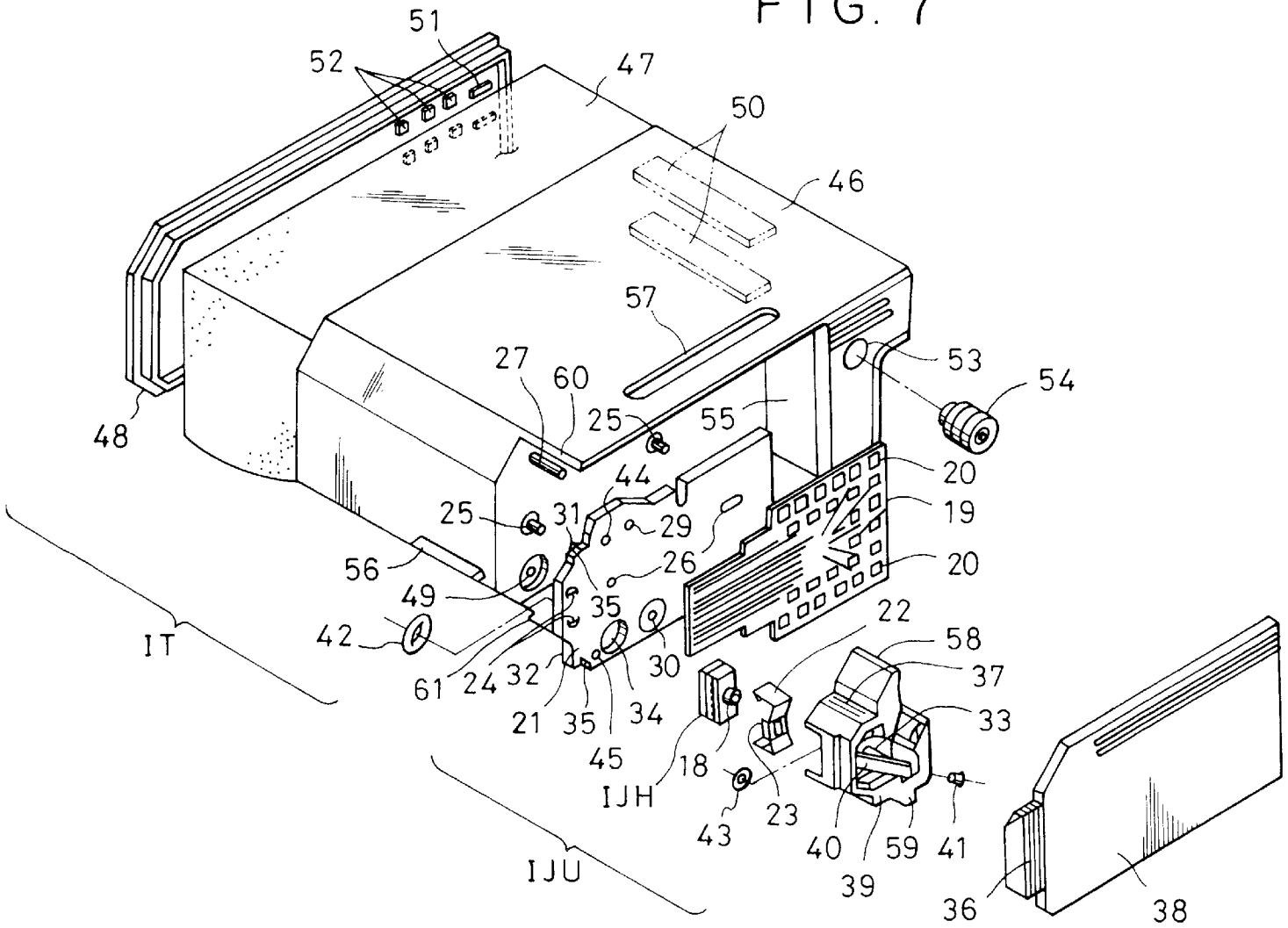
FIG. 7 illustrates an ink jet cartridge.
Figure 8:
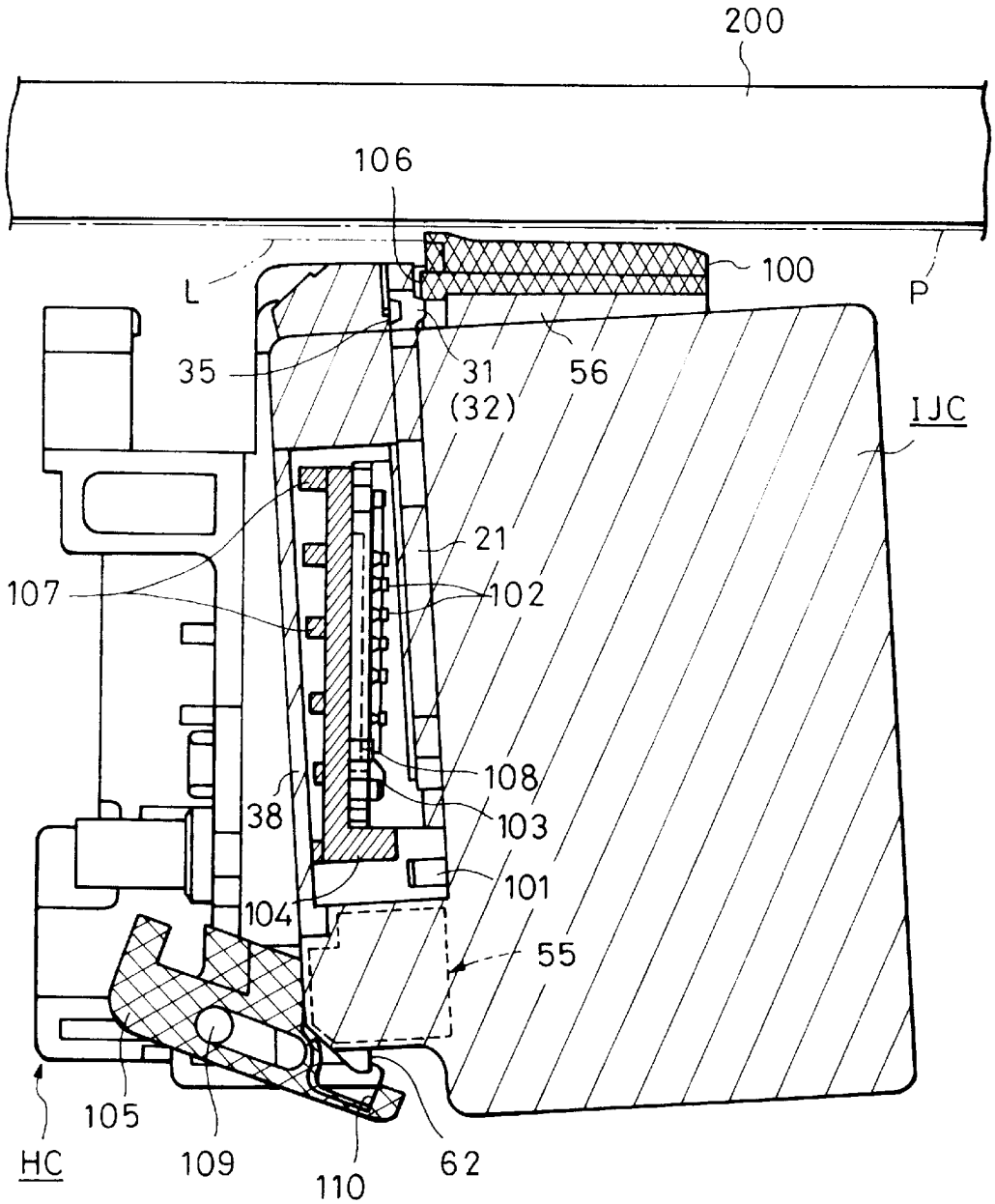
FIG. 8 illustrates mounting of the ink jet cartridge on a carriage of an apparatus.

FIG. 3 (*a*) is a perspective view of an ink jet recording head IJH employing the thin-film resistor element according to the present invention. FIG. 3 (*b*) is a cross-sectional view of the vicinity of the thin-film resistor element. FIG. 7 illustrates an ink jet cartridge IJC in which the ink jet recording head IJH is incorporated. FIG. 8 shows the state in which the ink jet cartridge IJC is mounted on a cartridge HC of an ink jet recording apparatus IJRA shown in FIG. 9.

The manufacturing process of the thin-film resistor element according to the present invention will be described below with reference to FIGS. 3 and 7 through 9.

First, the thin-film resistor element manufactured in the same manner as that of Example 1 was prepared, Next, a 50 $\mu$m-thick photosensitive resin dry film 12 was placed on the thin-film resistor element 1 in the manner shown in FIGS. 3 (*a*) and 3 (*b*), and exposure of the dry film using a predetermined pattern mask and subsequent development thereof were conducted to form liquid flow passages 13 and a common liquid chamber 14. Thereafter, a ceiling plate 15 made of glass was adhered on the film 12 through an epoxy resin type adhesive, whereby an ink jet recording head IJH was manufactured. Reference numeral 16 denotes a discharge port. Reference numeral 17 denotes an ink flow passage wall. Reference numeral 18 denotes an ink support port.

The first protective film 8 of the thus-prepared thin-film resistor element 1 has the function of preventing the portions of the interconnect electrodes 3 and 4 and heating resistor layer 7 located immediately below the liquid flow passage 13, from making contact with an ink when the thin-film resistor element 1 is incorporated in the ink jet recording head IJH. The first protective film 8 may be made of $SiO_2$, SiC or SiN.

The photosensitive dry film 12 is made of an organic insulator which prevents liquid penetration and exhibits excellent liquid resistance, such as an epoxy resin, a polyimide resin or a phenol resin. By forming the ink flow passage walls 17, the provision of a multi-head incorporating multiple discharge units, each of which consists of the discharge port 16, the liquid flow passage 13 and the heat generating portion 11 of the heating resistor layer 7, was enabled.

The ceiling plate 15 forms the ceiling of the liquid flow passage 13 in each of the discharge units. A ceiling plate 15 made of a metal plate, a ceramic or a plastic can also be used.

To join the photosensitive dry film 12 to the ceiling plate 15, an adhesive made of an epoxy resin or a cyanoacrylate resin is used.

In the ink jet recording head IJH, since $HfB_2$ having a high resistance and exhibiting excellent high-temperature stability is used to form the heating resistor layer 7, the recording head can meet the requirements of high-density and high-speed recording.

The structure of the recording head according to the present invention is not limited to the above-described one and various other structures can be adopted. For example, although the direction in which the liquid is supplied to the heat generating portion and the direction in which the liquid is discharged from the discharge port are almost the same in the shown recording head, they may be different, e.g., perpendicular to each other.

The thus-manufactured ink jet recording head IJH is incorporated in the ink jet cartridge IJC with an ink tank IT provided therein, as shown in FIG. 7. Such an ink jet cartridge IJC is mounted on the carriage HC, as shown in FIG. 8, to assemble the ink jet recording apparatus IJRA shown in FIG. 9.

The structure of the ink jet recording apparatus will now be described in brief.

An ink jet unit IJU is of the bubble jet type which performs recording using an electro-thermal transducer for generating thermal energy required to cause film boiling in an ink in response to an electrical signal.

In FIG. 7, reference numeral 19 denotes a wiring board for the thin-film resistor elements 1. The wiring board has wires corresponding to the interconnections of the elements (connection being made by, for example, wire bonding), and pads 20 each located at the end portion of the wire for receiving an electrical signal from the apparatus body.

Reference numeral 21 denotes a supporting member made of, for example, a metal. The supporting member 21 supports the rear surface of the wiring board 19 in a plane and serves as the bottom plate of the ink jet unit IJU. Reference numeral 22 denotes a pressing spring having an M-shaped form whose center presses the common liquid chamber 14 lightly. A front hanging portion 23 of the pressing spring locally and linearly presses part of the liquid passage, preferably, the area of the element near the discharge port 16. Leg portions of the pressing spring 22 pass through holes 24 in the bottom plate 21 and protrude from the rear surface thereof so as to allow the thin-film resistor elements 1 and the ceiling plate 15 to be brought into engagement in a state wherein they are sandwiched by the pressing spring. Consequently, the thin-film resistor elements 1 and the ceiling plate 15 are pressingly fixed by the localized urging force of the the pressing spring 22 and front handing portion 23 thereof.

The bottom plate 21 has positioning holes 26, 29 and 30 engaging with two positioning protrusions 25 and positioning and holding protrusions 27 and 28 (not shown) of the ink tank IT. Also, the bottom plate 21 has positioning protrusions 31 and 32 for positioning the carriage HC of the apparatus body IJRA on the rear surface thereof. In addition, the bottom plate 21 has a hole 34 which allows an ink supply pipe 33 assuring supply of the ink from the ink tank IT to pass therethrough. The wiring board 19 is mounted on the bottom plate 21 using an adhesive. Recessed portions 35 of the bottom plate 21 are provided near the positioning protrusions 31 and 32 thereof, respectively, in such a manner that they are located on extensions of the head distal area in which a plurality of parallel grooves 37 and 37 are formed on three sides thereof when the ink jet cartridge IJC is assembled so as to prevent unnecessary objects, such as dust or ink, from reaching the protrusions 31 and 32. A lid member 38 on which the parallel grooves 36 are formed forms the outer wall of the ink jet cartridge IJC and a space portion in which the ink tank IT and the ink jet unit IJU are accommodated. In an ink supply member 39 on which the parallel grooves 37 are formed, an ink conduit 40 which continues to the ink supply pipe 33 is formed as a cantilever whose side located near the supply pipe 33 is fixed. A sealing pin 41 for assuring capillarity in the fixed side of the ink conduit 40 and the ink supply pipe 33 is inserted into the ink conduit pipe 40. Reference numeral 42 denotes a packing for sealing the joint between the ink tank IT and the supply pipe 33, and reference numeral 43 denotes a filter provided on the tank side end portion of the supply pipe.

Because the ink supply member 39 is manufactured by molding, it is inexpensive, has a high positioning accuracy and thus avoids a decrease in accuracy during manufacture. In addition, since the conduit 40 forms a cantilever, pressing of the conduit 40 to the ink receiving ports 18 is stable even if the ink supply members are mass produced. In this example, the conduit 40 can communicate with the ink receiving ports 18 by supplying an adhesive from the side of the ink supply member in a state where the conduit 40 is pressed against the ink receiving ports 18. The ink supply member 39 is fixed to the bottom plate 21 by penetrating pins (not shown) provided on the rear surface of the ink supply member 39 through holes 44 and 45 in the bottom plate 21 and then by thermally melting the portions of the pins protruding from the rear surface of the bottom plate 21. The slightly protruding areas of the pins are accommodated in a recess (not shown) in a wall surface of the ink tank IT on which the ink jet unit IJU is mounted, and thus do not preclude accurate positioning of the unit IJU.

The ink tank IT includes a cartridge IJC body 46, and a lid member 48 for closing the cartridge IJC body 46 after an ink absorber 47 has been inserted into the cartridge body 46 from the side thereof located opposite to the surface of the cartridge body 47 on which the unit IJU is mounted.

The ink absorber 47 impregnated with ink is disposed in the cartridge body 46. An ink supply port 49 is a port through which the ink is supplied to the unit IJU and through which an ink is supplied before the unit is joined to the cartridge body 46 so as to allow the ink absorber 47 to be impregnated with ink.

In this example, although the ink can be supplied from both an atmosphere communication port and the ink supply port, since an air present area in the tank, formed by ribs 50 of the body 46 and partial ribs 51 and 52 of the lid member 48 so as to improve the ink supply property from the ink absorber, is located in communication with the atmosphere communication port 53 at the region farthest from the ink supply port 49, it is important for the ink to be supplied to the ink absorber from the ink supply port 49 so as to assure relatively excellent and uniform ink supply. Reference numeral 54 denotes a liquid repellent material disposed inwardly from the atmosphere communication port 53 so as to prevent ink leakage from the atmosphere communication port 53. The atmosphere communication port is formed in a protruding form and the inside of the protruding portion is made hollow so as to form an atmospheric pressure supply space 55 to the ink absorber 47.

Reference numeral 56 denotes a front collar of the ink tank IT which is inserted into a hole of a front plate 100 of the carriage so as to prevent excessive displacement of the ink tank. Reference numeral 101 denotes a protective member provided to oppose a bar (not shown) of the carriage HC. The protective member 101 is inserted below the bar when the cartridge IJC is turned and mounted on the carriage HC and prevents the cartridge from being removed from the carriage HC even when the cartridge is subjected to an upward force which unnecessarily removes the positioned cartridge in an upward direction. Reference numeral 57 denotes a slit formed in the cartridge IJC in such a manner that it is directed upwardly. The slit 57 prevents an increase in the temperature of the unit IJU caused by the heating of the head IJH, and prevents uniform temperature distribution in the unit IJU from being affected by an environment.

When the ink supply member 39 is assembled, an upper surface portion 58 of the ink supply member 39 and an end portion 60 of a roof portion of the ink tank IT form a slit, and a lower surface portion 59 of the ink supply member 39 and a head side end portion 61 of a thin plate member to which the lid 38 is adhered to the ink tank IT form a slit similar to the above-mentioned slit. These slits further accelerate radiation of heat from the slit 59, and prevent an unnecessary pressure applied to the tank IT from being exerted to the supply member and hence to the ink jet unit IJU.

In FIG. 8, reference numeral 200 denotes a platen roller for guiding a recording medium P from below the paper sheet to above thereof. The carriage HC, which is moved along the platen roller 200, includes a front plate 100 (having a thickness of 2 mm) disposed on the platen side of the carriage and on the front surface side of the ink jet cartridge IJC, a flexible sheet 103 having pads 102 corresponding to the pads 20 of the wiring board 19 of the cartridge IJC and a supporting plate 104 for an electrical connection which retains a rubber pad sheet 103 for generating an elastic force to press against the pads 102 from the rear surface side of the flexible sheet 103, and a positioning hook 105 for fixing the ink jet cartridge IJC to a recording position. The front plate 100 has two positioning protruding surfaces 106 corresponding to the positioning protrusions 31 and 32 of the bottom plate 21. The front plate 100 is subjected to a force directed to the protruding surfaces 106 after the cartridge is mounted on the carriage HC. Therefore, a plurality of reinforcing ribs (not shown) are formed on the side of the front plate which opposes the platen roller in the same direction as that in which the force is exerted. The ribs also form head protecting protruding portions which protrude from the front plate toward the platen roller from a front position L of the mounted cartridge IJC by a small distance (about 0.1 mm). The supporting plate 104 for electrical connection has a plurality of reinforcing ribs 107 which run not in a direction of the ribs but in a vertical direction. The protruding amount of the supporting plate 104 with which the supporting plate 104 protrudes sideways is reduced toward the hook 105 so as to allow the cartridge to be mounted slantingly, as shown in FIG. 8. In order to stabilize the electrically connected state, the supporting plate 104 has, on the hook side thereof, two positioning surfaces 108 corresponding to the protruding surfaces 106. The positioning surfaces 108 exert a force to the cartridge in a direction opposite to the direction in which the positioning protruding surfaces 106 exert a force to the cartridge, and form a pad contact area therebetween, and define the amount of deformation with which the pads of the rubber sheet 103 corresponding to the pads 102 are deformed. These positioning surfaces are brought into contact with the surface of the wiring board 19 when the cartridge IJC is fixed to a recordable position.

The hook 105 has an elongated hole which engages with a fixed shaft 109. The ink jet cartridge IJC is positioned relative to the carriage HC by pivoting the hook 105 counterclockwise from the position shown in FIG. 8 utilizing a moving space of the elongated hole and then by moving the hook 105 to the left along the platen roller 200. The hook 105 may be moved by using, for example, a lever. When the hook 105 is pivoted, the cartridge IJC is moved toward the platen roller while the positioning protrusions 31 and 32 are moved to a position where they can be brought into contact with the positioning surfaces 106 of the front plate. When the hook 105 is moved to the left, 90° hook surfaces 110 come close contact with 90° surfaces of a claw 62 of the cartridge IJC, the cartridge IJC is pivoted in a horizontal plane about the contact area between the positioning surfaces 31 and 106, and then the contact between the pads 20 and 102 begins. When the hook 105 is retained at a predetermined position, i.e., at a fixed position, the contact between the pads 20 and 102, the surface contact between the positioning surfaces 31 and 106, the two-surface contact between the 90° surfaces 110 and the 90° surfaces of the claw, and the surface contact between the wiring board 19 and the positioning surfaces 108 are achieved at the same time, whereby the retention of the cartridge IJC relative to the carriage is completed.

Figure 9:
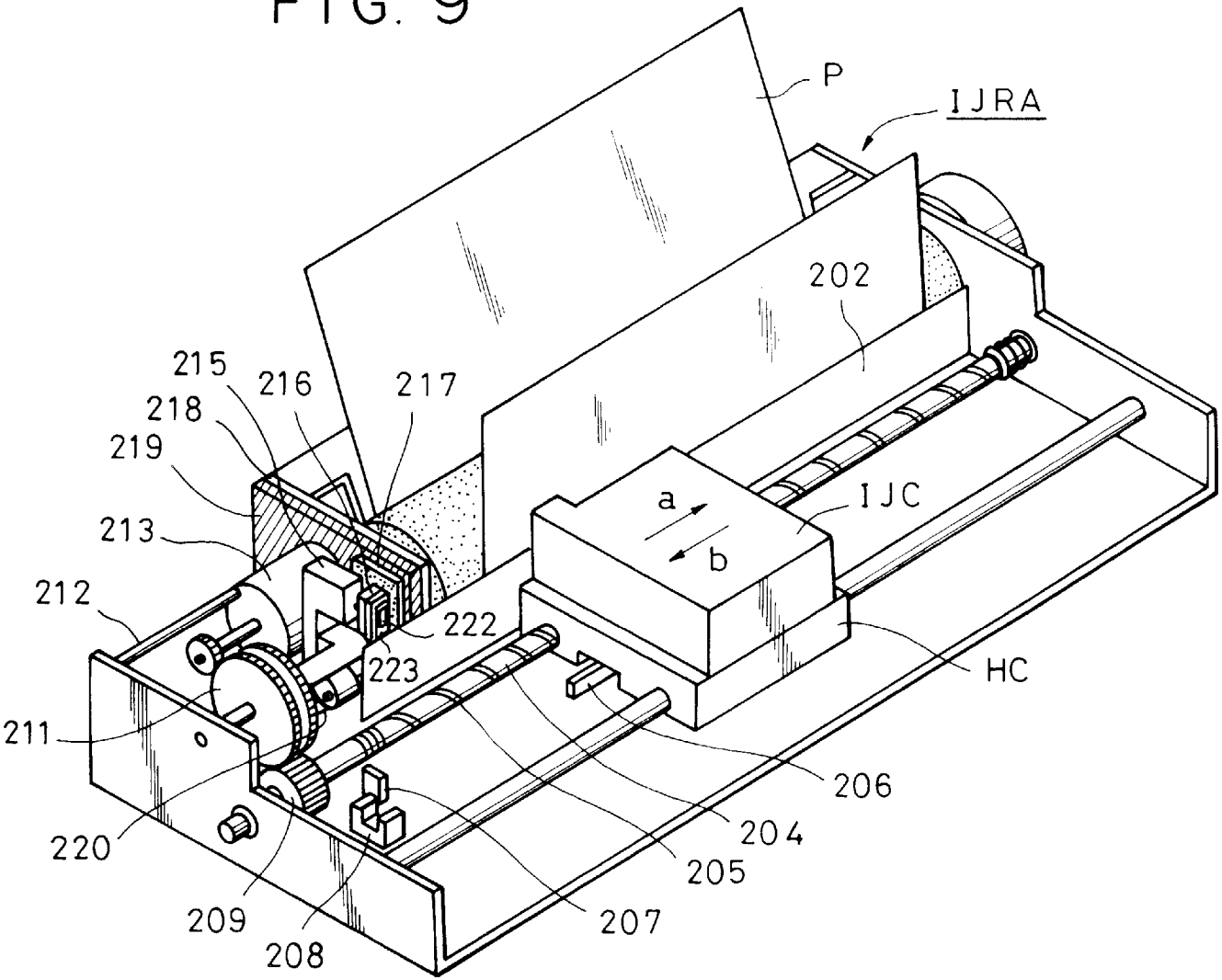
FIG. 9 illustrates the entire ink jet apparatus.

FIG. 9 conceptually illustrates the ink jet recording apparatus IJRA to which the present invention is applied. The rotation of a driving motor 213 in either of two directions is transmitted to a lead screw 204 through driving force transmission gears 209 and 211. The rotation of the lead screw 204 reciprocatingly moves the carriage HC engaging a helical groove 205 formed in the lead screw 204 in either of two directions indicated by arrows a and b. A paper pressing plate 202 presses the paper against the platen 200. A photocoupler 207 and 208 is home position detection means for detecting the presence of a lever 206 of the carriage in that area. The result of this detection is used to, for example, change over the direction of the rotation of the motor 213. A cap member 222 for capping the front surface of the recording head is supported by a member 216. Suction recovery of the recording head is performed through an in-cap opening 223 by suction means 215 for sucking the interior of the cap. A cleaning blade 217 is moved forwardly and backwardly by a member 219. The cleaning blade 217 and the member 219 are supported by a body supporting plate 218. Known cleaning blades other than the above-mentioned can also be used in the present invention. The suction recovery operation is initiated by a lever 212 which is moved by the movement of a cam 220 engaging the carriage to control the driving force of the driving motor by a known transmission means, such as a clutch change over.

The capping, cleaning and suction recovery means are constructed such that a desired operation is performed at a corresponding position when the carriage comes to the home position area by the action of the lead screw 204. However, any structure can be employed if that structure ensures that a desired operation is performed at a known timing. However, the aforementioned structure is an excellent one either as an individual structure or a composite structure, and is thus desirable.

The measurements of the amount of Ar in the first protective film in the thin-film resistor element manufactured in the manner described above using EPMA indicated that an average amount thereof was 6 wt %, as in the case of Example 1.

When recording was conducted in the manner equivalent to that in which an electric pulse was applied to the thin-film resistor elements $5\times10^7$ times (a first condition) and $1\times10^8$ times (a second condition), using the ink jet recording apparatus employing the thin-film resistor element manufactured in the manner described above (driving conditions: 10 $\mu$sec, 1 kHz, 26 volts), an abnormality, such as swelling of the protective film, did not appear in 20 thin-film resistor elements for both cases. In all the tests, the carriage HC and the body of the ink jet recording apparatus IJRA were common with only the ink jet cartridge IJC exchanged. In a Comparative Example 2, an abnormality occurred in 55% of 20 thin-film resistor elements under the first condition and in 85% under the second condition. However, in Example 9, since the protective film is formed such that it contains a lesser amount of Ar, the rate at which an abnormality of the protective film appears is reduced, i.e., the reliability of the ink jet cartridge is improved.

Again, the present invention is particularly advantageous when it is applied to a bubble jet type recording head or recording apparatus among various types of ink jet recording methods.

The typical configuration or principles of that bubble jet type recording method are disclosed in, for example, U.S. Pat. Nos. 4,723,129 and 4,740,796. Although the principles disclosed in these patents are applicable to both on-demand type apparatus and continuous type apparatus, they are effective when applied to an on-demand type because an on-demand type apparatus is constructed such that a bubble can be formed in a liquid (ink) in response to one driving signal applied to an electro-thermal transducer disposed in each sheet or path holding a recording liquid (ink). More specifically, when the at least one driving signal, corresponding to recording data and ensuring a rapid increase in the temperature of the ink exceeding a nucleate boiling, is applied to the electro-thermal transducer, the electro-thermal transducer generates sufficient thermal energy to cause a film boiling of the recording liquid on the heat acting surface of the recording head, resulting in formation of a bubble in one-to-one correspondence to the driving signal in the recording liquid. Expansion and contraction of the bubble generate a force which acts to discharge the recording liquid (ink) from the discharge opening so as to form at least one droplet of the recording liquid. Application of a driving signal in the form of a pulse is more desirable, because it assures expansion and contraction of the bubble on a real-time basis and thus enables a droplet to be discharged with good response to the driving signal. Examples of suitable driving pulse signals are disclosed in U.S. Pat. Nos. 4,463,359 and 4,345,262. The quality of the recording can be further improved by adopting the conditions disclosed in U.S. Pat. No. 4,313,124 which is directed to the rate of temperature rise of the above-mentioned heat acting surface in the recording head.

The construction of the recording head can be suitably determined by suitably designing the features of the discharge ports, liquid flow passages (straight or orthogonal) and electro-thermal transducers as they are disclosed in the aforementioned United States Patents. It is also possible to include a feature disclosed in U.S. Pat. Nos. 4,558,333 and 4,459,600 in which the heat acting surface is disposed in a curved region, a feature disclosed in Japanese Patent Laid-Open No. sho 59-123670 in which a slit, which is common to a plurality of electro-thermal transducers, serves as the discharge portion thereof, and a feature disclosed in Japanese Patent Laid-Open No. sho 59-138461 in which an opening for absorbing a pressure wave of thermal energy corresponds to the discharge portion.

The ink jet recording apparatus according to the present invention may be of the full-line type in which the recording head has a length corresponding to the width of the largest recording medium which is usable with that apparatus. In such a case, the recording head may be composed of a plurality of recording head modules as disclosed in the above-mentioned United States Patents or may be constructed as a unitary recording head. The above-described advantages of the present invention can be enhanced in such a full-line type apparatus regardless of whether the recording head is a unitary head or composed of a plurality of modules.

The recording head used in the ink jet recording apparatus of the present invention may be of replaceable head type, in which the head has electrical and ink supply systems that can be connected to the main part of the apparatus so that the replaceable head can be supplied with electric power and liquid when connected to the main part of the apparatus, or may be of cartridge type in which in which an ink supply tank is formed integrally with the recording head.

In order to optimize the effects produced by the present invention, it is desired to provide the head recovery means and various auxiliary means on the recording apparatus of the present invention. Examples of such means are capping means for capping the recording head, cleaning means for cleaning the recording head, pressurization or suction means, pre-heating means which may employ an electro-thermal transducer, a heating element other than the electro-thermal transducer or a combination thereof, and means for performing a preparatory discharge of the recording liquid prior to the recording.

The present invention can also be effectively applied to an ink jet recording apparatus of the type which performs recording in a main recording color, such as black, as well as a full-color recording of a plurality of different colors or of mixed colors which may be achieved by using a recording head composed of recording head modules or an integral recording recording head.

EXAMPLE 10

In Example 10, thin-film resistor elements were manufactured in the same manner as that of Example 9, and 20 ink jet cartridges IJC were manufactured in the same manner as that of Example 9 except for the conditions under which the protective film 8 was formed using those thin-film resistor elements. That is, the protective film 8 was formed under the conditions of Example 3 using Ar sputtering apparatus No. 1 marked by o in FIG. 10 and without using a heater. At that time, the Ar gas pressure was 3 mTorr, and the Rf power supplied was 8.0 kW.

The measurements of the amount of Ar in the protective film of each of the thin-film resistor elements manufactured in the manner described above indicated that the average amount thereof was 1.0 wt %, as in the case of Example 3.

When recording was conducted in the manner equivalent to that in which an electric pulse was applied to the thin-film resistor elements under the first and second conditions, using the ink jet recording apparatus IJRA used in Example 9 (driving conditions: 10 μsec, 1 kHz, 26 volts), an abnormality, such as swelling of the protective film, did not appear in thin-film resistor elements of 20 ink jet cartridges IJC manufactured in the manner described above for both cases. In Example 10, since the protective film is formed such that it contains an lesser amount of Ar, the rate at which an abnormality of the protective film appears is reduced, i.e., the reliability of the ink jet cartridge is improved.

Comparative Example 4

In Comparative Example 4, thin-film resistor elements were manufactured in the same manner as that of Example 9, and 20 ink jet cartridges IJC were manufactured in the same manner as that of Example 9 except for the conditions under which the protective film 8 was formed using those thin-film resistor elements. That is, the protective film 8 was formed under the conditions of Example 1 using Ar sputtering apparatus No. 5 marked by x in FIG. 10 and without using a heater. At that time, the Ar gas pressure was 4 mTorr, and the Rf power supplied was 4.0 kW.

The measurements of the amount of Ar in the protective film of each of the thin-film resistor elements manufactured in the manner described above indicated that the average amount thereof was 7.0 wt %.

When recording was conducted in the manner equivalent to that in which an electric pulse was applied to the thin-film resistor elements $10^8$ times, using the ink jet recording apparatus IJRA used in Example 9 (driving conditions: 10 μsec, 1 kHz, 26 volts), an abnormality, such as swelling of the protective film, appeared in 55% of thin-film resistor elements of 20 ink jet cartridges IJC manufactured in the manner described above under the first condition and in 85% of thin-film resistor elements under the second conditions.

The results of the examinations of Examples 1 through 10 and Comparative Examples 1 through 4 are shown in FIG. 11.

Pulses having a magnitude of 30 volts and a width of 3.0 μsec were applied at a driving frequency of 3.0 kHz to the thin-film resistor elements and to the ink jet heads each having the thin-film resistor element of the above-described Examples and Comparative Examples 1 and 4, and the number of pulses applied before the thin-film resistor element broke was measured. The number of pulses relative to the number of pulses of Comparative Example 1 is listed in FIG. 12.

It is apparent from the aforementioned results that a preferable amount of Ar in the protective film in contact with the heating portion of the heating resistor layer of the thin-film resistor element according to the present invention and of the thin-film resistor element used in the ink jet head according to the present invention is between 0.2 wt % and 6.0 wt %, with a more preferable range being between 0.2 wt % and 3.0 wt % and the most preferable range between 0.2 wt % and 1.0 wt %.

Examples of the thin-film resistor elements in which the protective film provided on the heating portion of the heating resistor layer has a single-layered structure have been described above.

Examples in which the protective film has a multi-layered structure will now be described below.

EXAMPLE 11

Figure 4A:
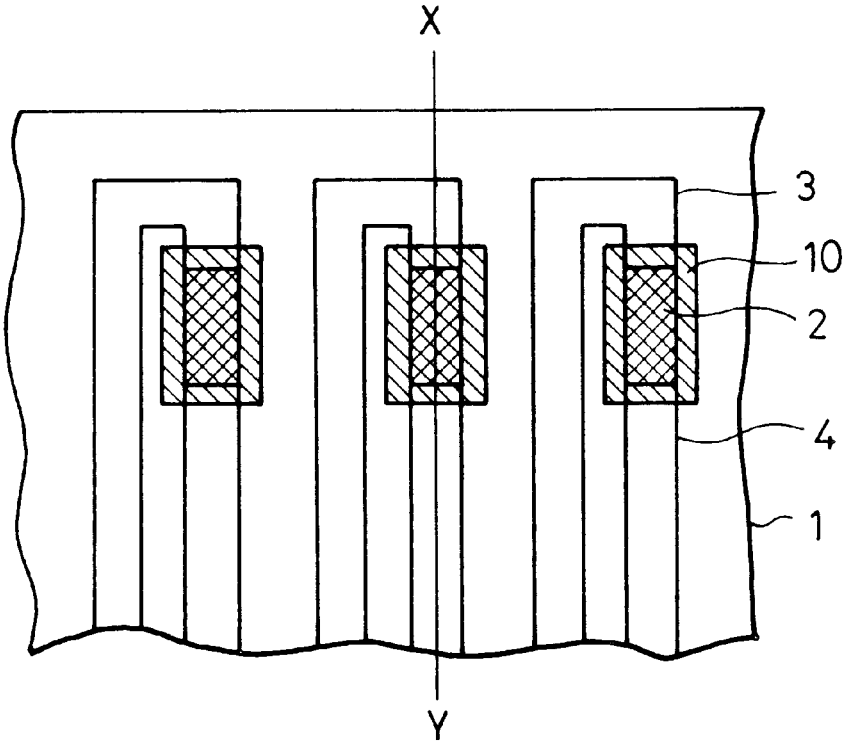
FIGS. 4 (*a*) and 4 (*b*) are schematic views illustrating the structure of the thin-film resistor element of the present invention and Comparative Examples.
Figure 4B:
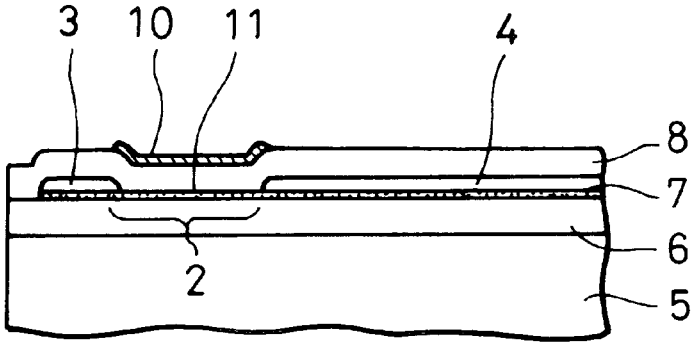

FIGS. 4 (*a*) and 4 (*b*) are respectively plan and cross-sectional views of Example 8 of the thin-film resistor element according to the present invention. In these figures, reference numeral 1 denotes the element (the entirety). Reference numeral 2 denotes a heating portion. Reference numerals 3 and 4 denote electrodes.

The manufacturing process of the thin-film resistor element according to Example 11 of the present invention will be described below.

First, a 5 μm-thick $SiO_2$ film was formed on the surface of a Si wafer which was an element supporting member 5 by thermal oxidation to form a lower layer 6 of the element 1. Next, a heating resistor layer 7 of $HfB_2$ was formed to a thickness of 1300 Å on the lower layer 6 by sputtering.

Subsequently, a Ti layer and an Al layer were sequentially deposited in 50 Å and 5000 Å, respectively, by electron beam deposition to form both the common interconnect electrode 3 and the selective interconnect electrode 4. At that time, a circuit pattern shown in FIG. 5 was formed by the photolithographic process. The heat acting surface of the heating portion 2 which forms a heat generating portion 11 for generating heat when a voltage is applied to the interconnect electrodes 3 and 4 had a width of 30 μm and a length of 150 μm. The resistance of the heating portion including that of the Al interconnect electrodes 3 and 4 was 100 Ω.

Next, the first protective film 8 was formed in two stages. In the first stage, the element supporting member 5 was set in an Ar sputtering apparatus (apparatus No. 5 marked by X in FIG. 10) in contact with a heater heated to 400° C., and the 1.0 μm-thick first lower protective film 8 made of $SiO_2$ was deposited on the entire surface of the element 1 in the manner shown in FIG. 4 by the magnetron type high-rate sputtering process. At that time, the Ar gas pressure was 4 mTorr, and the Rf power supplied was 4.0 kW. Next, in the second stage, a 1.0 μm-thick first upper protective film 8 made of $SiO_2$ was formed on the first lower protective film 8 in the Ar sputtering apparatus (apparatus No. 5 marked by x in FIG. 10) without heating the substrate. At that time, the Ar gas pressure was 4 mTorr. The Rf power applied was 2.0 kW. Subsequently, a 0.5 μm-thick second protective layer 10 was deposited by the magnetron type high-rate sputtering process. Next, the second protective layer 10 was photolithographically patterned such that it covered only the heating portion 2, as shown in FIGS. 4 (*a*) and 4 (*b*).

In addition to Si, an insulator, such as glass or a ceramic, may also be used as the material of the element supporting member 5. Any other material than $HfB_2$ can be used as the material of the heating resistor layer 7 which is heated to a very high temperature when the element is energized, if that material is stable at high temperatures and exhibits excellent oxidation resistance. Examples of such materials include a nitride, a carbide, a silicide and a fluoride of a high melting point or transition metal. A good conductor, such as Au or Cu, can also be used as the material of the interconnect electrodes 3 and 4.

The thickness of the protective film 8 and the width and length of the heating portion 2 are set to adequate values which assure the necessary characteristics of the heat generating portion 11 according to the design of the thin-film resistor element. In addition to $SiO_2$, SiC or SiN can also be used to form the protective film 8.

The measurements of the amount of Ar in the protective film of each of the thin-film resistor elements manufactured in the manner described above using EPMA indicated that the average amount of Ar in the first lower protective film was 6.0 wt % and that of Ar in the first upper protective film was 9 wt %.

The rate at which an abnormality, such as swelling of the protective film appeared in the thin-film resistor elements manufactured in the manner described above when a pulse voltage was applied thereto at 3 kHz for 10 μsec $5\times10^7$ times (hereinafter referred to as a first condition) or $1\times10^8$ times (hereinafter referred to as a second condition) was 0% in both cases.

EXAMPLE 12

In Example 12, the same thin-film resistor elements as those of Example 11 were manufactured in the same manner as that of Example 11 except for the conditions under which the first protective film was formed. That is, the first protective film was formed in the following manner in Example 12: in the first stage, the element supporting member 5 was set in an Ar sputtering apparatus (apparatus No. 5 marked by x in FIG. 10) in contact with a heater heated to 400° C., and a 1.0 μm-thick first lower protective film 8 made of $SiO_2$ was deposited on the entire surface of the element 1 in the manner shown in FIG. 4 by the magnetron type high-rate sputtering process. At that time, the Ar gas pressure was 4 mTorr, and the Rf power supplied was 4.0 kW. Next, in the second stage, a 1.0 μm-thick first upper protective film 8 made of $SiO_2$ was formed on the first lower protective film 8 in the Ar sputtering apparatus (apparatus No. 1 marked by o in FIG. 10) without heating the substrate. At that time, the Ar gas pressure was 3 mTorr. The Rf power applied was 8.0 kW. The measurements of the amount of Ar in the protective film of each of the thin-film resistor elements manufactured in the manner described above using EPMA indicated that the average amount of Ar in the first lower protective film formed in the first stage was 6.0 wt % and that of Ar in the first upper protective film formed in the second stage was 1.0 wt %.

The rate at which an abnormality, such as swelling of the protective film appeared in the thin-film resistor elements manufactured in the manner described above when a pulse voltage was applied thereto at 3 kHz for 10 μsec under the first and second conditions was 0% in both cases.

EXAMPLE 13

In Example 13, the same thin-film resistor elements as those of Example 11 were manufactured in the same manner as that of Example 11 except for the conditions under which the first protective film was formed. That is, the first protective film was formed in the following manner in Example 13: in the first stage, the element supporting member 5 was set in an Ar sputtering apparatus (apparatus No. 1 marked by o in FIG. 10) in contact with a heater heated to 600° C., and a 1.0 μm-thick first lower protective film 8 made of $SiO_2$ was deposited on the entire surface of the element 1 in the manner shown in FIG. 4 by the magnetron type high-rate sputtering process. At that time, the Ar gas pressure was 3 mTorr, and the Rf power supplied was 8.0 kW. Next, in the second stage, a 1.0 μm-thick first upper protective film 8 made of $SiO_2$ was formed on the first lower protective film 8 in the Ar sputtering apparatus (apparatus No. 5 marked by x in FIG. 10) without heating the substrate. At that time, the Ar gas pressure was 4 mTorr. The Rf power applied was 4.0 kW. The measurements of the amount of Ar in the protective film of each of the thin-film resistor elements manufactured in the manner described above using EPMA indicated that the average amount of Ar in the first lower protective film formed in the first stage was 0.2 wt % and that of Ar in the first upper protective film formed in the second stage was 9.0 wt %. The rate at which an abnormality, such as swelling of the protective film appeared in the thin-film resistor elements manufactured in the manner described above when a pulse voltage was applied thereto at 3 kHz for 10 μsec under the first and second conditions was 0% in both cases.

EXAMPLE 14

In Example 14, the same thin-film resistor elements as those of Example 11 were manufactured in the same manner as that of Example 11 except for the conditions under which the first protective film 8 was formed. That is, the first protective film was formed in the following manner in Example 14: in the first stage, the element supporting member 5 was set in an Ar sputtering apparatus (apparatus No. 1 marked by o in FIG. 10) in contact with a heater heated to 600° C., and a 1.0 μm-thick first lower protective film 8 made of $SiO_2$ was deposited on the entire surface of the element 1 in the manner shown in FIG. 4 by the magnetron type high-rate sputtering process. At that time, the Ar gas pressure was 3 mTorr, and the Rf power supplied was 8.0 kW. Next, in the second stage, a 1.0 μm-thick first upper protective film 8 made of $SiO_2$ was formed on the first lower protective film 8 in the Ar sputtering apparatus (apparatus No. 1 marked by o in FIG. 10) without heating the substrate. At that time, the Ar gas pressure was 3 mTorr. The Rf power applied was 8.0 kW. The measurements of the amount of Ar in the protective film of each of the thin-film resistor elements manufactured in the manner described above using EPMA indicated that the average amount of Ar in the first lower protective film formed in the first stage was 0.2 wt % and that of Ar in the first upper protective film formed in the second stage was 1.0 wt %. The rate at which an abnormality, such as swelling of the protective film appeared in the thin-film resistor elements manufactured in the manner described above when a pulse voltage was applied thereto at 3 kHz for 10 μsec under the first and second conditions was 0% in both cases.

Comparative Example 5

In Comparative Example 5, the same thin-film resistor elements as those of Example 11 were manufactured in the same manner as that of Example 11 except for the conditions under which the first protective film 8 was formed. That is, the first protective film was formed in the following manner in the single stage and using the single apparatus in Comparative Example 5: the element supporting member 5 was set in an Ar sputtering apparatus (apparatus No. 5 marked by x in FIG. 10) without the member being heated, and a 2.0 μm-thick first protective film 8 made of $SiO_2$ was deposited on the entire surface of the element 1 in the manner shown in FIG. 4 by the magnetron type high-rate sputtering process. At that time, the Ar gas pressure was 4 mTorr, and the Rf power supplied was 4.0 kW.

The measurements of the amount of Ar in the protective film of each of the thin-film resistor elements manufactured in the manner described above using EPMA indicated that the average amount thereof was 7.0 wt %.

The rate at which an abnormality, such as swelling of the protective film appeared in the similarly manufactured thin-film resistor elements when a pulse voltage was applied thereto at 3 kHz for 10 μsec under the first and second conditions was 60% in both cases.

The reason why the rate was that high was because the amount of Ar in the film in contact with the heating resistor layer was too high.

Comparative Example 6

In Comparative Example 6, the same thin-film resistor elements as those of Example 11 were manufactured in the same manner as that of Example 11 except for the conditions under which the first protective film 8 was formed. That is, the first protective film was formed in the following manner in the single stage and using the single apparatus in Comparative Example 6: the element supporting member 5 was set in an Ar sputtering apparatus (apparatus No. 1 marked by o in FIG. 10) in contact with a heater heated to 600° C., and a 2.0 μm-thick first protective film 8 made of $SiO_2$ was deposited on the entire surface of the element 1 in the manner shown in FIG. 4 by the magnetron type high-rate sputtering process. At that time, the Ar gas pressure was 3 mTorr, and the Rf power supplied was 8.0 kW.

The measurements of the amount of Ar in the protective film of each of the thin-film resistor elements manufactured in the manner described above using EPMA indicated that the average amount thereof was 0.2 wt %.

When a pulse voltage was applied to the thin-film resistor elements manufactured in the manner described above at 3 kHz for 10 μsec under the first and second conditions, no abnormality, such as swelling of the protective film, appeared in the elements. However, the rate at which peeling of the protective film between the first and second protective films appeared was 50%.

Comparative Example 7

In Comparative Example 7, the same thin-film resistor elements as those of Example 11 were manufactured in the same manner as that of Example 11 except for the conditions under which the first protective film 8 was formed. That is, the first protective film was formed in the following manner in the single stage and using the single apparatus in Comparative Example 7: the element supporting member 5 was set in an Ar sputtering apparatus (apparatus No. 1 marked by o in FIG. 10) in contact with a heater heated to 500° C., and a 2.0 μm-thick first protective film 8 made of $SiO_2$ was deposited on the entire surface of the element 1 in the manner shown in FIG. 4 by the magnetron type highrate sputtering process. At that time, the Ar gas pressure was 3 mTorr, and the Rf power supplied was 8.0 kW.

The measurements of the amount of Ar in the protective film of each of the thin-film resistor elements manufactured in the manner described above using EPMA indicated that the average amount thereof was 0.9 wt %.

When a pulse voltage was applied to the thin-film resistor elements manufactured in the manner described above at 3 kHz for 10 μsec under the first and second conditions, no abnormality, such as swelling of the protective film, appeared in the elements. However, the rate at which peeling of the protective film between the first and second protective films appeared was 50%.

Comparative Example 8

In Comparative Example 8, the same thin-film resistor elements as those of Example 11 were manufactured in the same manner as that of Example 11 except for the conditions under which the first protective film 8 was formed. That is, the first protective film was formed in the following manner in Comparative Example 8: in the first stage, the element supporting member 5 was set in an Ar sputtering apparatus (apparatus No. 5 marked by x in FIG. 10) without the member being heated, and a 1.0 μm-thick first protective film 8 made of $SiO_2$ was deposited on the entire surface of the element 1 in the manner shown in FIG. 4 by the magnetron type high-rate sputtering process. At that time, the Ar gas pressure was 4 mTorr, and the Rf power supplied was 4.0 kW. Next, in the second stage, a 1.0 μm-thick first protective film 8 made of $SiO_2$ was formed in the Ar sputtering apparatus (apparatus No. 5 marked by x in FIG. 10) without heating the substrate. At that time, the Ar gas pressure was 15 mTorr. The Rf power applied was 1.0 kW.

The measurements of the amount of Ar in the protective film of each of the thin-film resistor elements manufactured in the manner described above using EPMA indicated that the average amount of Ar in the first protective film formed in the first stage (the first lower protective film 8) was 7.0 wt % while that of Ar in the first protective film formed in the second stage (the first upper protective film 8) was 10.0 wt %.

When a pulse voltage was applied to the thin-film resistor elements manufactured in the manner described above at 3 kHz for 10 μsec under the first and second conditions, abnormality, such as swelling of the protective film appeared in 40% of the elements under the first condition and in 70% of the elements under the second condition. The rate at which peeling of the protective film between the first and second protective films appeared under the first condition was about 5%, and the rate at which peeling appeared under the second condition was about 10%.

Next, Examples of the ink jet head in which the protective film has a multi-layered structure according to the present invention will be described.

EXAMPLE 15

Figure 5A:
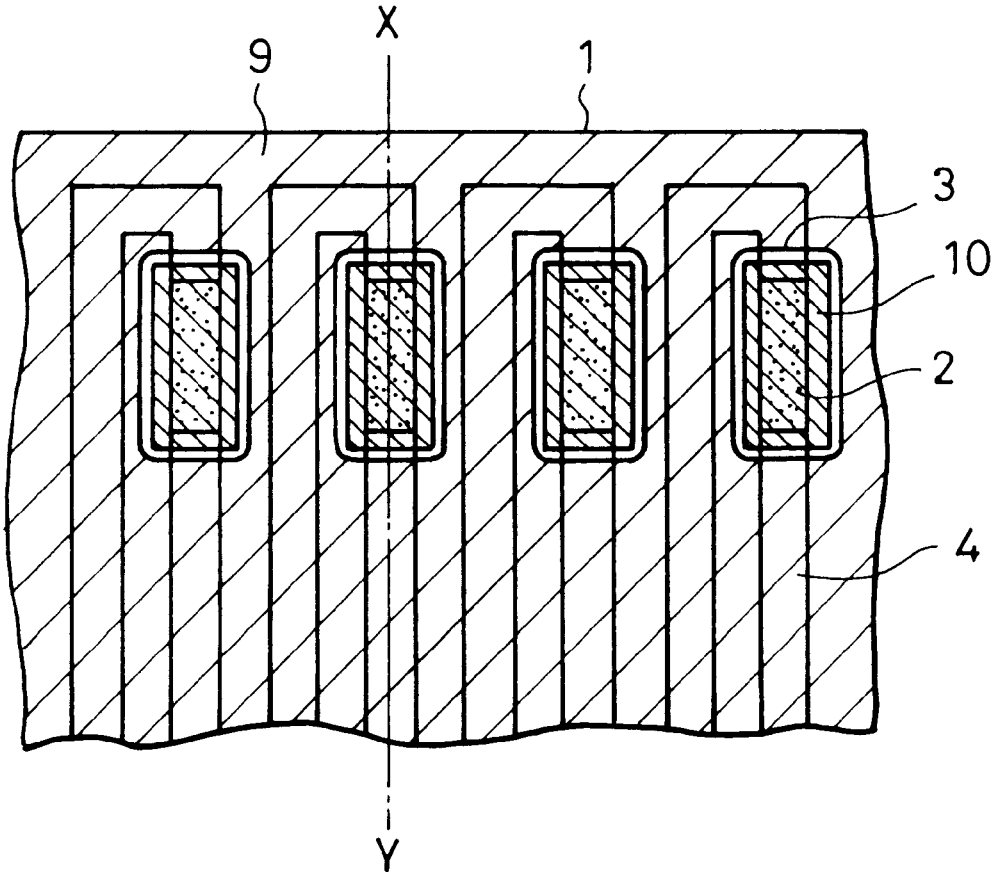
FIGS. 5 (*a*) and 5 (*b*) are schematic views illustrating the structure of the thin-film resistor element of the present invention and Comparative Examples.
Figure 5B:
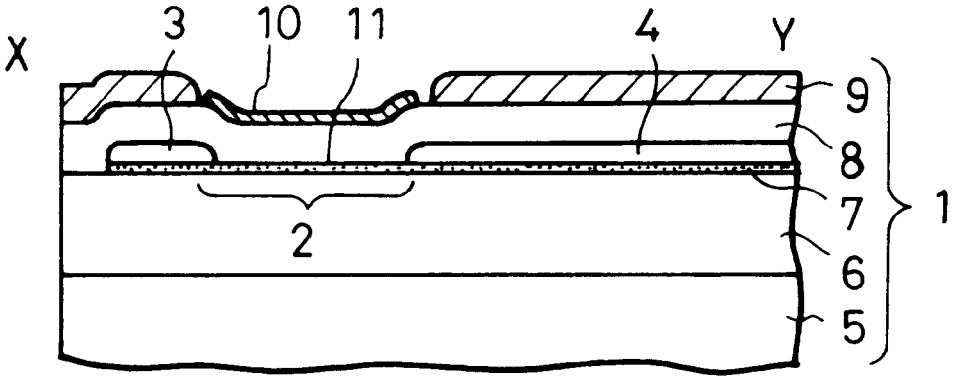
Figure 6:
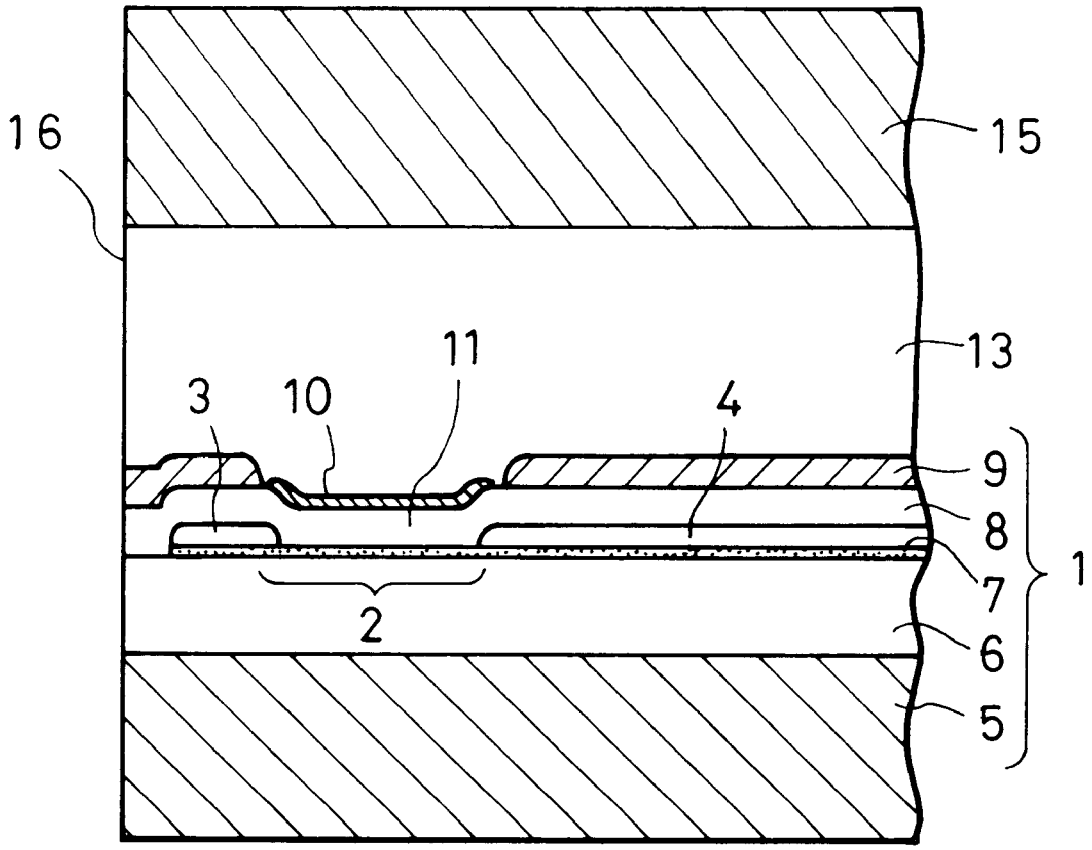
FIG. 6 illustrates the structure of the ink jet head according to the present invention.

FIGS. 5 (*a*) and 5 (*b*) are respectively plan and cross-sectional views of the thin-film resistor element according to the present invention. FIG. 6 is a cross-sectional view of part of an ink jet recording head IJH employing the thin-film resistor elements according to the present invention which is the vicinity of the thin-film resistor element.

The structures of the ink jet head, ink jet cartridge and ink jet apparatus are the same as that shown in FIGS. 7 through 9, description thereof being omitted.

First, the thin-film resistor element manufactured in the same manner as that of Example 11 was prepared. Next, a third upper protective film 9 having a circuit pattern shown in FIGS. 5 (*a*) and 5 (*b*) was formed by coating a photosensitive polyimide (trade name: Photoneece) on the first protective film 8 of the element 1 and then by photolithographically patterning the coated resin.

Subsequently, liquid flow passages 13 and a common liquid chamber were formed by placing a 50 $\mu$m-thick photosensitive resin dry film on the thus-manufactured thin-film resistor element 1 in the manner shown in FIG. 6 and then conducting exposure of the dry film using a predetermined pattern mask and subsequent development thereof. Thereafter, a ceiling plate 15 made of glass was adhered onto the film 12 through an epoxy resin type adhesive, whereby an ink jet recording head IJH was manufactured. Reference numeral 16 denotes a discharge port. Reference numeral 17 denotes an ink flow passage wall. Reference numeral 18 denotes an ink support port.

The first protective film 8 of the thus-prepared thin-film resistor element 1 has the function of preventing the portions of the interconnect electrodes 3 and 4 and heating resistor layer 7 located immediately below the liquid flow passage 13 from making contact with an ink when the thin-film resistor element 1 is incorporated in the ink jet recording head IJH. The first protective film 8 may be made of $SiO_2$, SiC or SiN. The second protective film 10 is a cavitation-resistant layer. It may also be made of a metal other than Ta.

The photosensitive dry film 12 is made of an organic insulator which prevents liquid penetration and exhibits excellent liquid resistance, such as an epoxy resin, a polyimide resin or a phenol resin. By forming the ink flow passage walls 17, the provision of a multi-head incorporating multiple discharge units, each of which consists of the discharge port 16, the liquid flow passage 13 and the heat generating portion 11 of the heating resistor layer 7, was enabled.

The ceiling plate 15 forms the ceiling of the liquid flow passage 13 in each of the discharge units. A ceiling plate 15 made of a metal plate, a ceramic or a plastic can also be used.

To join the photosensitive dry film 12 to the ceiling plate 15, an adhesive made of an epoxy resin or a cyanoacrylate resin is used.

In the ink jet recording head IJH, since $HfB_2$ having a high resistance and exhibiting excellent high-temperature stability is used to form the heating resistor layer 7, the resulting recording head can meet the requirements of high-density and high-speed recording.

The structure of the recording head according to the present invention is not limited to the above-described one and various other structures can be adopted. For example, although the direction in which the liquid is supplied to the heat generating portion and the direction in which the liquid is discharged from the discharge port are almost the same in the shown recording head, they may be different, e.g., perpendicular to each other.

The thus-manufactured ink jet recording head IJH is incorporated in the ink jet cartridge IJC with an ink tank IT provided therein, as shown in FIG. 7. Such an ink jet cartridge IJC is mounted on the carriage HC, as shown in FIG. 8, to assemble the ink jet recording apparatus IJRA shown in FIG. 9.

The structure of the ink jet recording apparatus and the description in connection with FIGS. 7 through 9 are the same as that in Example 6.

The amount of Ar in the first protective film of each of the thin-film resistor elements manufactured in the manner described above was measured using EPMA. The average amount of Ar in the first lower protective film formed in the first stage was 6 wt %, and that in the first upper protective film formed in the second stage was 9.0 wt %.

When recording was conducted in the manner equivalent to that in which an electric pulse was applied to the thin-film resistor elements under the first and second conditions, using the ink jet recording apparatus employing the thus-manufactured thin-film resistor elements (driving conditions: 10 $\mu$sec, 1 kHz, 26 volts), an abnormality such as swelling of the protective film or peeling thereof between the first and second protective layers did not appear in thin-film resistor elements for both cases. At that time both the carriage HC and the ink jet recording apparatus IJRA body were common, and only the ink jet cartridge IJC was exchanged.

The prevent invention is particularly effective when it is applied to a bubble jet type recording head or apparatus in various types of ink jet recording apparatuses.

The typical structure and principle, the structure of a recording head, the provision of recovery means and preliminary auxiliary means in the recording head and the recording mode of the recording apparatus are the same as those described in connection with Example 6.

EXAMPLES 16 THROUGH 18

In Examples 16 through 18, thin-film resistor elements were manufactured in the same manner as that of Example 15, and 20 ink jet cartridges IJC were manufactured in the same manner as that of Example 15 except for the conditions under which the first protective film 8 was formed using those thin-film resistor elements. That is, the first protective films 8 of Examples 16 through 18 were formed under the conditions of Examples 12 through 14, respectively.

The amount of Ar in the first protective film of each of the thin-film resistor elements manufactured in the manner described above was measured using EPMA. The average amount of Ar in the first protective film of Example 16 was the same as that obtained in Example 12. The average amount thereof obtained in Example 17 was the same as that obtained in Example 13. The average amount thereof obtained in Example 18 was the same as that obtained in Example 14.

When recording was conducted in the manner equivalent to that in which an electric pulse was applied to the thin-film resistor elements under the first and second conditions, using the ink jet recording apparatus IJRA used in Example 15 (driving conditions: 10 μsec, 1 kHz, 26 volts), an abnormality such as swelling of the protective film or peeling thereof between the first and second protective layers did not appear in the thin-film resistor elements of all the 20 ink jet cartridges IJC manufactured in the manner described above for both cases in Examples 16 through 18.

Comparative Examples 9 and 11

In Comparative Examples 9 and 11, thin-film resistor elements were manufactured in the same manner as that of Example 15, and 20 ink jet cartridges IJC were manufactured in the same manner as that of Example 15 except for the conditions under which the first protective film 8 was formed, using those thin-film resistor elements. That is, the first protective films 8 of Comparative Examples 9 through 11 were formed under the conditions of Comparative Examples 5 through 8, respectively.

The amount of Ar in the first protective film of each of the thin-film resistor elements manufactured in the manner described above was measured using EPMA. The average amount of Ar in the first protective film of Comparative Example 9 was the same as that obtained in Comparative Example 5. The average amount thereof obtained in Comparative Example 10 was the same as that obtained in Comparative Example 6. The average amount thereof obtained in Comparative Example 11 was the same as that obtained in Comparative Example 8

When recording was conducted in the manner equivalent to that in which an electric pulse was applied to the thin-film resistor elements $10^8$ times, using the ink jet recording apparatus IJRA used in Example 6 (driving conditions: 10 μsec, 1 kHz, 26 volts), swelling of the protective film appeared in 30% of the thin-film resistor elements of all the 20 ink jet cartridges IJC manufactured in the manner described above under the first condition and in 70% under the second condition in Comparative Example 9. In Comparative Example 10, swelling of the protective film did not appear in any of the thin-film resistor elements. In Comparative Example 11, it appeared in 60% of the thin-film resistor elements under the first condition and in 90% under the second condition. Peeling of the protective film between the first upper protective film and the second upper protective film did not appear in any of the thin-film resistor elements in Comparative Example 9. Peeling of the protective film appeared in 0% of the thin-film resistor elements under the first condition and in 50% under the second condition in Comparative Example 10. In Comparative Example 11, peeling of the protective film appeared in 5% of the thin-film resistor elements under the first condition and in 20% under the second condition.

The results of the experiments of Examples 11 through 18 and Comparative Examples 5 through 11 are shown in FIG. 13.

It is apparent from the aforementioned results of the experiments that in a thin-film resistor element in which the protective film provided on the heating resistor layer has a multi-layered structure, a preferable amount of Ar contained in the first lower protective film (located in contact with the heating resistor layer) is between 0.2 wt % and 6.0 wt % in terms of the prevention of peeling of the film, and that a preferable amount of Ar contained in the first upper protective layer (located in contact with the second protective layer) is between 1.0 wt % and 9.0 wt % from the viewpoint of prevention of peeling of the film.

Other Examples

The prevent inventors conducted experiments to study the desirable ratio of the upper protective film to the lower protective film in the first protective film when the protective film has a multi-layered structure. The results of the experiments will now be described.

Thin-film resistor elements were manufactured in the same manner as that of each of Examples 11 and 13. At that time, the lower and upper film forming times were adjusted to change the lower and upper areas in the first protective film.

FIG. 14 shows the results of the experiments.

In this example, the ratio of the upper area to the lower area was changed in the manner shown in FIG. 14 (11-1 through 11-5 and 13-1 through 13-5) in the thin-film resistor elements manufactured in the same manner as that of Example 11 in which the amount of Ar in the first lower protective film was 6.0 wt % while that in the first upper protective film was 9.0 wt % and in the thin-film resistor elements manufactured in the same manner as that of Example 13 in which the amount of Ar in the first lower protective film was 0.2 wt % while that in the first upper protective film was 9.0 wt %.

It can be seen from the results of the experiments that a desirable ratio of the lower area to the upper area in the first protective film is 40% or above (excluding a case in which the upper area is 0 wt %) and a more desirable ratio is 50% or above.

The present inventors consider that a lower area having a certain size or above is required because peeling between the first and second protective films is affected by the coupling state of the joining surface between the first and second protective films and swelling between the first protective film and the heating resistor layer is affected by the diffusion of Ar.

As will be understood from the foregoing description, in the thin-film resistor element, the proportion of Ar atoms in the protective film which is the component of the element, measured by the electron beam micro analyzer (EPMA), is set between 0.2 wt % and 6.0 wt %, or in the case of a protective film having a multi-layered structure, the proportion of Ar atoms contained in the lower area of the first protective film, disposed above the heating portion, is set between 0.2 wt % and 6.0 wt %, and that in the upper area of the first protective film is set between 1.0 wt % and 9.0 wt %. Consequently, the rate at which an abnormality of the protective film occurs is reduced, thus improving the reliability of the thin-film resistor element and hence that of the ink jet head and ink head apparatus employing such an element.

What is claimed is:

1. An ink-jet recording head having a multi-layer protective structure comprising:

a heating resistor for discharging ink;

a first protective layer provided in contact with said heating resistor;

a second protective layer provided in contact with said first protective layer;

an ink flow passage provided over said second protective layer and corresponding to said heating resistor;

said first protective layer containing argon in an amount which, in the direction of thickness of said first protective layer, is less in a region thereof in contact with said heating resistor than in a region in contact with said second protective layer.

2. An ink jet recording head according to claim 1, wherein the amount of argon is said first protective layer is between 0.2 wt % and 6.0 wt % in a region thereof in contact with said heating resistor, and between 1.6% wt % and 9.0 wt % in a region in contact with said second protective layer.

3. An ink jet recording apparatus comprising:

an ink jet recording head having a multi-layer protective structure which includes:

a heating resistor, a first protective layer in contact with said heating resistor;

a second protective layer in contact with said first protective layer;

an ink flow passage provided over said second protective layer and corresponding to said heating resistor;

said first protective layer containing argon in an amount which, in the direction of thickness thereof, is less in a region thereof in contact with said heating resistor than in a region in contact with said second protective layer; and means arranged to supply a signal to said ink jet recording head.

4. An ink jet recording apparatus according to claim 3, wherein the amount of argon in said first protective layer is between 0.2 wt % and 6.0 wt % in a region thereof in contact with said heating resistor, and between 1.6 wt % and 9.0 wt % in a region in contact with said second protective layer.

5. In the manufacture of a recording head, the steps of:

providing a substrate having disposed thereon a heating resistor layer and at least one electrode electrically connected thereto;

forming a first protective layer in contact with the heating resistor layer;

forming a second protective layer in contact with said first protective layer;

wherein said first protective layer is formed to contain argon such that the amount of argon contained therein, in the direction of thickness of said first protective layer, is less in the region thereof in contact with said heating resistor than in the region thereof in contact with said second protective layer.

6. A method according to claim 5 further including the step of baking said substrate so that said amount of argon in said protective layer is reduced to between 0.2 wt % and 6.0 wt %.

7. A method according to claim 5, wherein the amount of argon in said first protective layer is between 0.2 wt % and 6.0 wt % in a region thereof in contact with said heating resistor, and between 1.6 wt % and 9.0 wt % in a region in contact with said second protective layer.

8. A method according to claim 5, wherein said forming step comprises bias sputtering in an argon containing atmosphere, and wherein said protective layer includes silicon dioxide.

9. A method according to claim 5, wherein said amount of argon in said protective layer is reduced to between 0.2 wt % to 3.0 wt %.

10. A method according to claim 5, wherein said amount of argon in said protective layer is reduced to between 0.2 wt % to 1.0 wt %.

11. A method according to claim 5, further comprising the steps of providing an ink container and causing said recording head to communicate with said ink container.

* * * * *

UNITED STATES PATENT AND TRADEMARK OFFICE

CERTIFICATE OF CORRECTION

PATENT NO. : 5,946,013

DATED : August 31, 1999

INVENTOR(S) : SUOMI KURIHARA ET AL.

It is certified that error appears in the above-identified patent and that said Letters Patent is hereby corrected as shown below:

COLUMN 5

Line 5, "thickness," should read --thicknesses,--.

COLUMN 6

Line 10, "less" should read --a lesser--;
Line 11, "resisto" should read --resistor--.

COLUMN 7

Line 9, "lesser" should read --a lesser--;
Line 51, "hat" should read --that--.

COLUMN 14

Line 21, "at least" should be deleted;
Line 31, "generate" should read --generates--.

COLUMN 15

Line 7, "in which" (second occurrence) should be deleted;
Line 26, "recording" (second occurrence) should be deleted;
Line 52, "an" should read --a--.

COLUMN 17

Line 46, "abnormality," should read --abnormality--.

COLUMN 22

Line 36, "prevent" should read --present--.

UNITED STATES PATENT AND TRADEMARK OFFICE

CERTIFICATE OF CORRECTION

PATENT NO. : 5,946,013

DATED : August 31, 1999

INVENTOR(S) : SUOMI KURIHARA ET AL.

It is certified that error appears in the above-identified patent and that said Letters Patent is hereby corrected as shown below:

COLUMN 23

Line 28, "in" should read --in Comparative Example 8.--.

COLUMN 24

Line 2, "prevent" should read --present--.

Signed and Sealed this

Nineteenth Day of September, 2000

*Attest:*

Q. TODD DICKINSON

*Attesting Officer*

*Director of Patents and Trademarks*